US008842842B2

(12) United States Patent
Eppolito et al.

(10) Patent No.: US 8,842,842 B2
(45) Date of Patent: Sep. 23, 2014

(54) DETECTION OF AUDIO CHANNEL CONFIGURATION

(75) Inventors: Aaron M. Eppolito, Santa Cruz, CA (US); Iroro F. Orife, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 697 days.

(21) Appl. No.: 13/019,294

(22) Filed: Feb. 1, 2011

(65) Prior Publication Data

US 2012/0195433 A1 Aug. 2, 2012

(51) Int. Cl.

| | |
|---|---|
| ***H04R 5/00*** | (2006.01) |
| ***H04S 3/00*** | (2006.01) |
| *G10L 21/0216* | (2013.01) |

(52) U.S. Cl.

CPC ..... *H04S 3/008* (2013.01); *G10L 2021/02161* (2013.01); *H04S 2400/03* (2013.01)

USPC ..... 381/19

(58) Field of Classification Search

CPC ..... H04B 1/14; H04H 20/89

USPC ..... 381/1, 18, 56, 63, 97, 104, 106, 107, 381/119, 306, 309, 19–23; 700/94

See application file for complete search history.

(56) References Cited

U.S. PATENT DOCUMENTS

| | | | | |
|---|---|---|---|---|
| 4,389,536 | A * | 6/1983 | Schickedanz | 381/11 |
| 4,455,673 | A * | 6/1984 | Topping et al. | 381/12 |
| 5,155,770 | A * | 10/1992 | Maejima | 381/18 |
| 5,159,638 | A * | 10/1992 | Naito et al. | 704/213 |
| 5,210,796 | A * | 5/1993 | Hirabayashi et al. | 381/12 |
| 6,392,135 | B1 | 5/2002 | Kitayama | |
| 6,507,658 | B1 | 1/2003 | Abel et al. | |
| 6,881,888 | B2 | 4/2005 | Akazawa et al. | |
| 6,968,564 | B1 | 11/2005 | Srinivasan | |
| 7,072,477 | B1 | 7/2006 | Kincaid | |
| 7,383,509 | B2 | 6/2008 | Foote et al. | |
| 7,440,577 | B2 * | 10/2008 | Coats | 381/119 |
| 7,548,791 | B1 | 6/2009 | Johnston | |
| 7,549,123 | B1 | 6/2009 | Stewart et al. | |
| 7,653,550 | B2 | 1/2010 | Schulz | |
| 7,698,009 | B2 | 4/2010 | Cotey et al. | |
| 7,756,281 | B2 | 7/2010 | Goldstein et al. | |

(Continued)

OTHER PUBLICATIONS

U.S. Appl. No. 13/019,986, filed Feb. 2, 2011, Eppolito, Aaron M., et al.

(Continued)

*Primary Examiner* — Vivian Chin
*Assistant Examiner* — William A Jerez Lora
(74) *Attorney, Agent, or Firm* — Blakely, Sokoloff, Taylor & Zafman LLP

(57) ABSTRACT

For an audio file that includes multiple channels of audio data, a novel device for detecting the configuration of the audio channels in the multi-channel audio file is presented. The device performs one or more algorithms to determine whether two or more channels are related. Such algorithms are used to distinguish stereo recordings from dual mono recordings. The algorithms are also used to detect any number of related channels, such as distinguishing six related channels from a set of surround sound microphones versus six unrelated channels (e.g., mono or a mixture of stereo and mono audio channels, etc.) These algorithms compare audio channels in pairs in order to determine which channels are sufficiently related as to constitute a stereo pair or a group.

23 Claims, 22 Drawing Sheets

(56) References Cited

U.S. PATENT DOCUMENTS

| | | | | |
|---|---|---|---|---|
| 7,769,189 | B1 | 8/2010 | Moulios et al. | |
| 7,870,589 | B2 | 1/2011 | Ducheneaut et al. | |
| 7,945,142 | B2 | 5/2011 | Finkelstein et al. | |
| 8,006,195 | B1 | 8/2011 | Woodings et al. | |
| 8,108,219 | B2 * | 1/2012 | Liebchen | 704/500 |
| 2002/0023103 | A1 | 2/2002 | Gagne | |
| 2002/0138795 | A1 | 9/2002 | Wang | |
| 2002/0143545 | A1 | 10/2002 | Tamura et al. | |
| 2002/0177967 | A1 | 11/2002 | Fuchs et al. | |
| 2004/0066396 | A1 | 4/2004 | Hatakenaka | |
| 2004/0120554 | A1 | 6/2004 | Lin et al. | |
| 2004/0122662 | A1 | 6/2004 | Crockett | |
| 2004/0264714 | A1 | 12/2004 | Lu et al. | |
| 2005/0042591 | A1 | 2/2005 | Bloom et al. | |
| 2005/0273321 | A1 | 12/2005 | Choi | |
| 2006/0156374 | A1 | 7/2006 | Hu et al. | |
| 2006/0174267 | A1 | 8/2006 | Schmidt | |
| 2006/0274902 | A1 * | 12/2006 | Hume et al. | 381/17 |
| 2006/0293902 | A1 * | 12/2006 | Kim et al. | 704/500 |
| 2007/0121966 | A1 | 5/2007 | Plastina et al. | |
| 2007/0274540 | A1 * | 11/2007 | Hagen et al. | 381/119 |
| 2007/0292106 | A1 | 12/2007 | Finkelstein et al. | |
| 2008/0002844 | A1 | 1/2008 | Chin | |
| 2008/0253577 | A1 | 10/2008 | Eppolito | |
| 2008/0253592 | A1 | 10/2008 | Sanders et al. | |
| 2008/0256136 | A1 | 10/2008 | Holland | |
| 2009/0087161 | A1 | 4/2009 | Roberts et al. | |
| 2009/0103752 | A1 | 4/2009 | Chou et al. | |
| 2009/0129601 | A1 | 5/2009 | Ojala et al. | |
| 2009/0226052 | A1 * | 9/2009 | Fedele et al. | 382/125 |
| 2010/0183280 | A1 | 7/2010 | Beauregard et al. | |
| 2010/0189266 | A1 | 7/2010 | Oh et al. | |
| 2010/0323793 | A1 * | 12/2010 | Andall | 463/35 |
| 2011/0007915 | A1 | 1/2011 | Park | |
| 2011/0013084 | A1 | 1/2011 | Black | |
| 2011/0054916 | A1 * | 3/2011 | Thumpudi et al. | 704/500 |
| 2012/0185068 | A1 | 7/2012 | Eppolito | |

OTHER PUBLICATIONS

U.S. Appl. No. 13/151,181, filed Jun. 1, 2011, Eppolito, Aaron M.
U.S. Appl. No. 13/151,199, filed Jun. 1, 2011, Eppolito, Aaron M.
U.S. Appl. No. 13/226,244, filed Sep. 6, 2011, Eppolito, Aaron M.
U.S. Appl. No. 13/215,534, filed Aug. 23, 2011, Eppolito, Aaron M.
Author Unknown, "Additional Presets," Month Unknown, 2007, pp. 1-2, iZotope, Inc., USA.
Author Unknown, "Adobe Premiere Pro CS3: User Guide," Apr. 1, 2008, 455 pages, Adobe Systems Incorporated, San Jose, California, USA.
Author Unknown, "Apple Announces Final Cut Pro 4," NAB, Apr. 6, 2003, pp. 1-3, Apple Inc., Las Vegas, Nevada, USA.
Author Unknown, "Frame-specific editing with Snap", Adobe Premiere Pro CS4 Classroom in a Book, Dec. 17, 2008, 17 pages, Adobe Press, USA.
Author Unknown, "Octogris by UDM," Month Unknown, 2000-2011, pp. 1-3, KVR Audio Plugin Resources, USA.
Author Unknown, "PCM 81 Presets," Month Unknown, 1998, 8 pages, Lexicon Inc., Bedford Massachusetts, USA.
Author Unknown, "Spectron—64-bit Spectral Effect Processor," Month Unknown, 2007, pp. 1-3, iZotope, Inc, Cambridge, Massachusetts, USA.
Lee, Taejin, et al., "A Personalized Preset-based Audio System for Interactive Service," Audio Engineering Society (AES) 121st Convention, Oct. 5-8, 2006, pp. 1-6, San Francisco, California, USA.
Sauer, Jeff, "Review: Apple Final Cut Pro 4", Oct. 3, 2003, pp. 1-7, USA.

* cited by examiner

DETECTION OF AUDIO CHANNEL CONFIGURATION

BACKGROUND

Audio capturing devices such as video cameras or field recorders often record more than two channels of audio, sometimes four channels, sometimes eight or ten, etc. The inputs to these channels may vary widely depending on what the user has plugged into the device. For example, a HDV camera running in four channel mode may have microphones plugged into all four channels or may have microphones plugged into only three of the channels. Of the microphones that are plugged in, some may be mono microphones, each of which produces one channel of audio data unrelated to other channels, while others may be stereo microphones, each of which produces a pair of closely related stereo channels.

Different configurations of microphones and recording equipment produce audio files that need to be processed differently. For example, a 3-channel audio file produced by a configuration of a stereo microphone pair and one mono microphone must be processed differently than a 3-channel audio file produced by another configuration of three mono microphones. In this example, the two stereo channels of the first configuration need to be assigned to a pair of stereo speakers, while the mono channels of the second configuration need not be so assigned. Failure to map audio channels to the appropriate speakers or audio equipment would likely result in unintended, and possibly disturbing, auditory distortions or dissonance. Therefore, it is important for a media editing application processing an audio file to be cognizant of the configuration of microphones and recording equipment that produced the audio file.

Unfortunately, the configuration of microphones and recording equipment that produces an audio file is not always readily apparent to a media editing application processing the audio file. For example, an audio file that includes one mono channel and a pair of stereo channels usually does not include information on which two channels are stereo channels and which channel is the mono channel. A user of a media editing application intending to incorporate the audio from the audio file must, therefore, explicitly choose a configuration of audio channels. This is usually a manual process that is both tedious and prone to error.

What is needed is an apparatus or a method for automatically detecting the configuration of audio channels, a method that automatically eliminates silent channels and determines the relationships between remaining audio channels.

SUMMARY

For an audio file that includes multiple channels of audio data, some embodiments provide a method for detecting the configuration of the audio channels in the multi-channel audio file. Some embodiments perform one or more algorithms to determine whether two or more channels are related. In some embodiments, such algorithms are used to distinguish stereo recordings from dual mono recordings. In some of these embodiments, the algorithms are also used to detect any number of related channels. For example, the algorithms in some embodiments are used to distinguish six related channels of a set of surround sound microphones from combinations of six unrelated channels (e.g., mono or a mixture of stereo and mono audio channels, etc.) These algorithms compare sets of audio channels (e.g., in pairs) in order to determine which channels are sufficiently related as to constitute a stereo pair or a group.

Examples of algorithms for comparing a set of audio channels include (i) higher order zero crossing analysis and (ii) cross correlation or phase correlation. Based on these algorithms, some embodiments generate a comparison score and determine whether two channels are sufficiently close by examining whether the comparison score satisfies a threshold value. Using higher order zero crossing analysis for determining whether two channels are sufficiently related includes generating a zero crossing spectrum for each of the two channels and comparing the generated zero crossing spectrums. A zero crossing spectrum for an audio channel includes a collection of zero crossing counts. Each zero crossing count corresponds to the number of times a higher order difference function of the audio signal crosses zero. Using cross correlation or phase correlation for determining whether two audio channels are sufficiently related includes performing a correlation operation of the two audio channels. The correlation operation yields a peak correlation value, which is used for comparison with a threshold value for determining whether the two audio channels are sufficiently related.

Before comparing a set of audio channels, some embodiments examine each audio channel for valid or useful audio content. A channel determined to lack valid or useful audio content will not be compared to other audio channels. To determine whether a channel contains valid or useful content, some embodiments examine whether the audio level in the audio channel exceeds a floor level. In some embodiments, the floor level is fixed at a predetermined level. Some embodiments determine the floor level by using intrinsic characteristics of the audio channel.

In addition, some embodiments perform data reduction on the audio channels prior to comparing the audio channels. Data reduction reduces the number of data samples in the audio channels. Some embodiments perform data reduction by re-sampling the data in an audio channel at a sampling frequency that is lower than the original sampling frequency of the audio channel. Some embodiments perform data reduction by computing running averages of the data in the audio channel.

The preceding Summary is intended to serve as a brief introduction to some embodiments of the invention. It is not meant to be an introduction or overview of all inventive subject matter disclosed in this document. The Detailed Description that follows and the Drawings that are referred to in the Detailed Description will further describe the embodiments described in the Summary as well as other embodiments. Accordingly, to understand all the embodiments described by this document, a full review of the Summary, Detailed Description and the Drawings is needed. Moreover, the claimed subject matters are not to be limited by the illustrative details in the Summary, Detailed Description and the Drawing, but rather are to be defined by the appended claims, because the claimed subject matters can be embodied in other specific forms without departing from the spirit of the subject matters.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION

In the following description, numerous details are set forth for the purpose of explanation. However, one of ordinary skill in the art will realize that the invention may be practiced without the use of these specific details. In other instances, well-known structures and devices are shown in block diagram form in order not to obscure the description of the invention with unnecessary detail.

For an audio file that includes multiple channels of audio data, some embodiments provide a method for detecting the configuration of the audio channels in the multi-channel audio file. Some embodiments perform one or more algorithms to determine whether two or more channels are related. In some embodiments, such algorithms are used to distinguish stereo recordings from dual mono recordings. In some of these embodiments, the algorithms are also used to detect any number of related channels. For example, the algorithms in some embodiments are used to distinguish six related channels of a set of surround sound microphones from a combination of six unrelated channels (e.g., mono or a mixture of stereo and mono audio channels, etc.) Some of these algorithms compare audio channels in pairs in order to determine which channels are sufficiently related as to constitute a stereo pair or a group.

Figure 1:
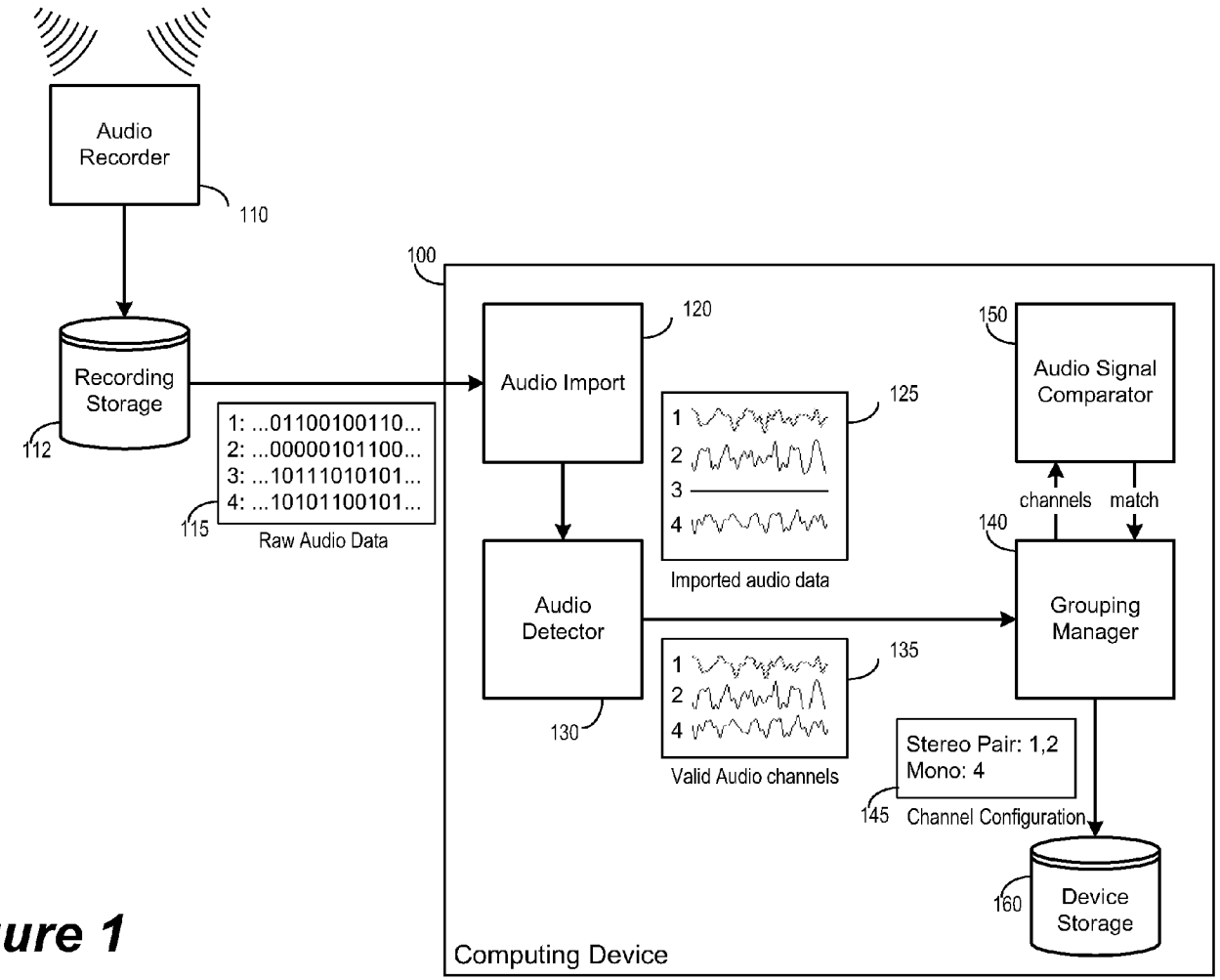
FIG. 1 illustrates an example block diagram of a computing device that performs an audio channel configuration detection operation.

In some embodiments of the invention, channel configuration detection is performed by a computing device. Such a computing device can be an electronic device that includes one or more integrated circuits (IC) or a computer executing a program, such as a media editing application. FIG. 1 illustrates an example block diagram of a computing device 100 that performs the audio channel configuration detection operation. The computing device 100 includes an audio import module 120, an audio detector module 130, a grouping manager module 140, an audio signal comparator module 150, and a device storage 160 of the computing device 100.

The computing device 100 performs audio channel configuration detection on raw audio data 115 that is imported into the computing device 100. The raw audio data 115 in some embodiments is imported from a recording storage 112 that stores the raw audio data 115 based on the sound or audio captured by an audio recorder 110. The raw audio data 115 can be a single file containing all audio channels, a collection of files in which each file includes one or more audio channels, a stream of bits communicated from the audio recorder 110 to the computing device 100, or any other form of digital data capable of conveying recorded sound to the computing device 100.

The audio recorder 110 captures sound and stores the captured sound in the recording storage 112. The audio recorder 110 can be a video camera, a field recorder, a microphone that is plugged into the computing device 100, or any other type of device capable of capturing sound. In some embodiments, the audio recorder 110 includes sound recording devices that are part of the computing device 100, such as a computer's built in microphone.

In some embodiments, the audio recorder 110 records multiple channels of audio or sound by using multiple recording devices associated with multiple channel inputs. The recording devices can be in different configurations that include different combinations of different types of recording devices. For example, an audio recorder that has six channel inputs, 1-6, can have a topology of recording devices that includes a pair of stereo microphones that are plugged into channel inputs 3 and 4. The same audio recorder can also have another topology of recording devices that includes a set of surround sound microphones plugged into all six of its channel inputs. As mentioned above, some embodiments of the invention perform automatic detection of audio channel configuration. These detected audio channel configurations, in some embodiments, are based on the different configurations of recording devices at the audio recorder 110.

In some embodiments, the sound or audio captured by the audio recorder 110 are recorded in a digitized form of audio signals, sometimes referred to as audio data. Audio data includes audio samples, which are digital representations of the recorded sound produced by sampling the original analog audio signal at a particular sampling rate. Such audio data (or digitized audio signals) is divided into audio channels. Each audio channel contains audio data that corresponds to the sound or audio captured at a particular channel input of the audio recorder 110 by a particular recording device. An audio channel is said to have content if the audio data in the audio channel represents sound that is of interest to a user. An audio channel is also said to have no content if the audio data does not represent sound that is of interest to a user, such as when no microphone is plugged into the corresponding channel input or when the audio data of the channel represents only background noise. Examples of the audio recorder 110 and the configurations of recording devices is further explained by reference to FIGS. 3 and 4 below.

In some embodiments, the audio recorder 110 stores the audio data of the different audio channels as raw audio data 115 in the recording storage 112. The recording storage 112 is a memory device that stores recorded sound (i.e., the raw audio data 115) for later retrieval. In some embodiments, the recording storage 112 stores a copy of the recorded sound either directly from the audio recorder 110, or indirectly via another storage device, such as a flash drive, a hard drive of a computer, a storage location in a computer network, or any other medium capable of storing digital data. In some embodiments, the recording storage is a temporary storage (e.g., RAM components) that is used as a real-time transit of recorded sound between the audio recorder 110 and the computing device 100.

In some embodiments, the recording storage 112 is a built-in storage that resides in the same recording device as the audio recorder 110. In some embodiments, the recording storage 112 is a memory device that is independent of the audio recorder 110. Such a recording storage can be a stand-alone storage, such as a flash drive, a hard drive, or any other medium capable of storing digital data. The recording storage 112 can also be a memory structure that is a part of the computing device 100, or a part of an electronic system that includes the computing device 100 (e.g., the hard drive or the memory of a computer executing a media editing application.) The recording storage 112 can also be a memory structure or memory device that is located elsewhere in a network to which the computing device 100 has access.

The audio import module 120 imports raw audio data 115 from the recording storage 112 and parses the raw audio data 115 into a format that can be processed by the computing device 100. In some embodiments, the raw audio data 115 can come in a variety of different formats. Different formats of raw audio data can have different representations of audio data (e.g., different placements of audio channels within a file, different conventions of representing an audio sample, different number of bits used to represent each audio sample, etc.). The audio import module 120 in these embodiments parses the audio channels in these different representations into a format that can be processed by other modules of the computing device 100. In some of these embodiments, the audio import module 120 can be programmed to specifically parse a particular format of raw audio data. In some embodiments, the raw audio data 115 includes information on the sampling rate of the audio data. The audio import module 120 in some of these embodiments would extract the sampling rate from the raw audio data 115.

In some embodiments, the audio import module 120 imports multiple instances of the raw audio data 115 to create one instance of imported audio data that is properly parsed and formatted. In some such embodiments, the multiple raw audio data can come from different recording storage devices storing different portions (e.g., different channels) of a recording.

The audio detector module 130 provides indications of valid audio channels 135 to the grouping manager module 140. The audio detector module 130 receives the imported audio data 125 from the audio import module 120 and detects valid audio channels 135 in the imported audio data 125. As mentioned earlier, some of the audio channels may not contain useable audio data (i.e., the channels are without content), such as a silent channel that does not have a microphone plugged in. The audio detector 130 determines which audio channel has useable or valid data (i.e., with content) and generates corresponding indicators of useable or valid channels. In some embodiments, the determination of useable or valid channels is based on a comparison between the audio data of the channel with a floor level audio. The audio detector 130 is further explained below by reference to FIGS. 6 and 7.

The grouping manager module 140 produces a channel configuration 145 based on a comparison of channels performed by the audio signal comparator 150. The grouping manager module 140 receives the imported audio data 125 along with indications of useable or valid channels from the audio detector 130. The grouping manager 140 selects a pair of audio channels to send to the audio signal comparator 150 and receives a matching indicator for indicating whether the two audio channels are sufficiently similar with each other. The grouping manager 140 then selects another pair of audio channels to send to the audio signal comparator 150 for determining whether those two channels are sufficiently similar with each other. Based on the results of these comparisons, the grouping manager 140 derives an audio channel configuration data 145 and stores it in the device storage 160.

The audio signal comparator module 150 compares the two audio channels selected by the grouping manager 140 and determines whether their content is sufficiently similar. If the two channels are sufficiently similar, the audio signal comparator 150 generates a matching indication for the grouping manager 140. Different embodiments of the audio signal comparator 150 perform the comparison of audio channels differently. Some embodiments perform the comparison of audio channels by higher order zero crossing analysis, while some other embodiments perform the comparison by correlation. These different embodiments of the audio signal comparator module 150 will be further described below by reference to FIGS. 8-20.

The device storage 160 is a storage associated with the computing device 100 that can receive and store the channel configuration 145 generated by the grouping manager 140. The device storage 160 can be a random access memory (RAM), a hard drive, a flash drive, or any other memory structure or device that can hold the channel configuration data for retrieval by an operation or a computer program that needs the channel configuration information (e.g., a media editing application that requires the channel configuration information for assigning channels to the appropriate speakers).

Figure 2A:
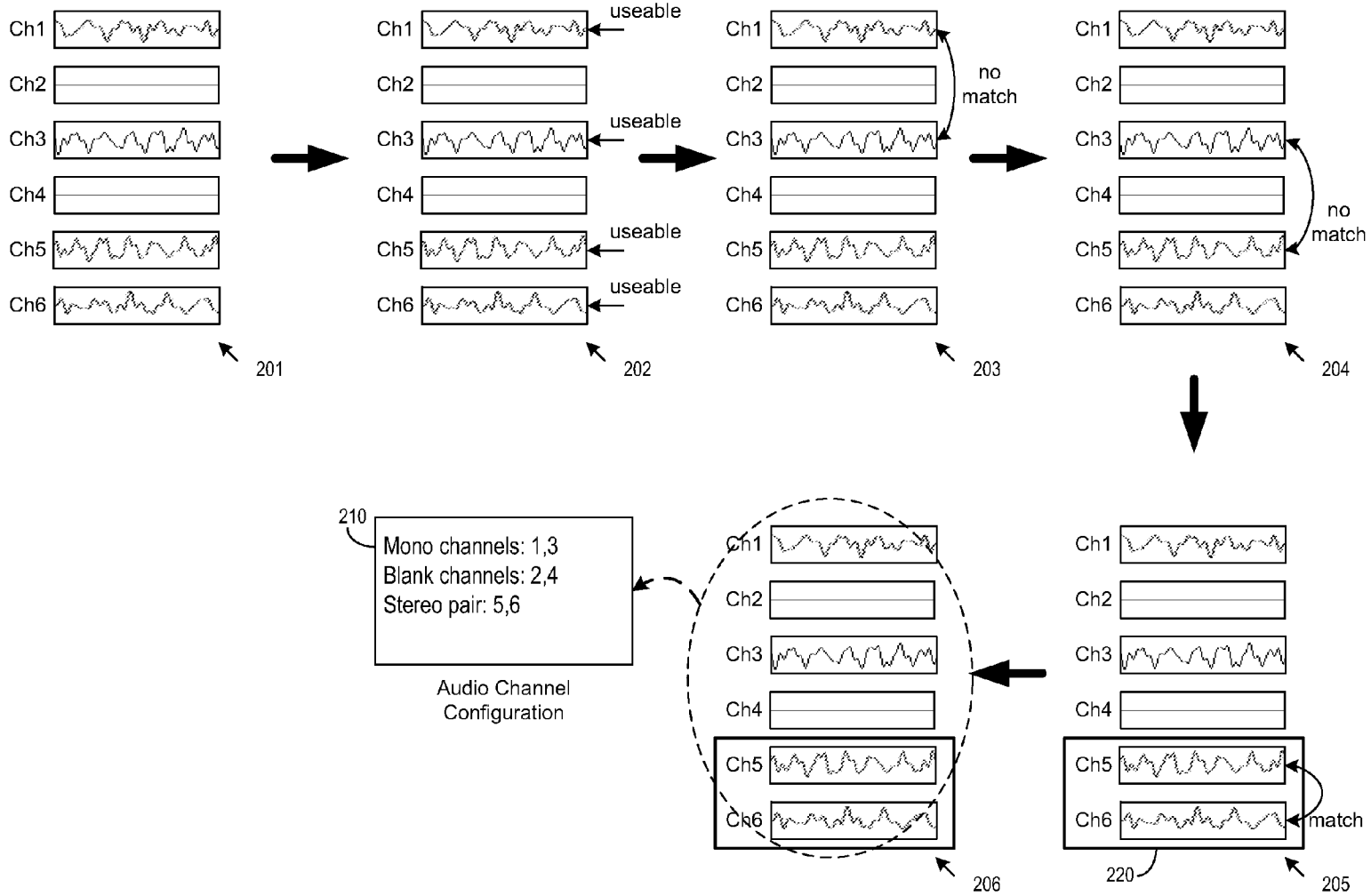
FIG. 2*a* illustrates an example audio channel configuration operation that detects a pair of stereo channels.

The audio channel configuration detection operations, as performed by the computing device 100, will now be described by reference to FIGS. 2*a* and 2*b*. FIG. 2*a* illustrates an example audio channel configuration operation that detects a pair of stereo channels. In this example, the computing device 100 compares successive audio channels in order to find two audio channels that match each other. FIG. 2*a* illustrates this comparing process in six stages 201-206.

As illustrated in stage 201 of FIG. 2*a*, six channels of audio data are presented to the computing device 100. Channels labeled as "Ch1", "Ch3", "Ch5" and "Ch6" have valid audio data, while channels labeled as "Ch2" and "Ch4" are silent and have no audio content (e.g., no microphones are plugged in for these two audio channels).

The second stage 202 shows the detection of useable or valid audio channels. In some embodiments, the operation at stage 202 is performed by the audio detector module 130 of the computing device 100. The computing device 100 examines the audio data of each channel and determines which channels contain usable audio content and which channels do not. The computing device 100 then tags each channel as having or not having useable or valid audio content. In this example, all channels are tagged as having useable audio content except "Ch2" and "Ch4", which are illustrated with flat lines to indicate that they do not have valid audio content. Some embodiments detect useable or valid audio channels by comparing audio data against a floor level for audio.

The third stage 203 shows the comparison of audio channels "Ch1" and "Ch3". Since "Ch2" has already been determined as having no useable audio data, the computing device 100 skips "Ch2" and selects "Ch3" for comparison with "Ch1". In this example, the computing device 100 receives an indication (i.e., "no match") that these two channels are not sufficiently similar. Therefore, computing device 100 does not mark "Ch1" and "Ch3" as a pair of audio channels. In some embodiments, the comparison of audio channels is performed by the audio signal comparator 150, while the selection of channels for comparison is performed by the grouping manager 140.

The fourth stage 204 shows the comparison of audio channels "Ch3" and "Ch5". Since audio channel "Ch4" has previously been determined as having no useable audio content, the computing device 100 skips "Ch4" and selects "Ch5" for comparison with "Ch3". In this example, the computing device 100 receives an indication (i.e., "no match") that these two channels are not sufficiently similar. Thus, computing device 100 does not mark "Ch3" and "Ch5" as a pair of audio channels.

The fifth stage 205 shows the comparison of audio channels "Ch5" and "Ch6". In this example, the computing device 100 receives an indication (i.e., "match") that these two channels are sufficiently similar. Accordingly, the computing device 100 marks "Ch5" and "Ch6" as a pairing of channels, denoted by the rectangle 220.

At the sixth stage 206, the computing device 100 generates an audio channel configuration data 210 based on the results of the operations performed during stages 201-205. In some embodiments, the channels that have been tagged as not having useable or valid content are reported as being blank channels, the pair of channels that have been identified as being a matching pair are reported as being a stereo pair, and channels that have data not part of a pairing are reported as mono channels. In this example, "Ch1" and "Ch3" are identified as mono channels, "Ch2" and "Ch4" are identified as blank channels, and "Ch5" and "Ch6" are identified as being a stereo pair. In some embodiments, the grouping manager module 140 of the computing device 100 generates the audio channel configuration data 210 based on operations performed during stages 202-205. In some of these embodiments, the generated audio channel configuration data 210 is stored in the device storage 160.

Instead of detecting only one pair of stereo channels, the computing device 100 in some embodiments determines whether the set of channels belong to a surround sound group. A surround sound group generally includes a channel for a mono center speaker, two channels for a pair of stereo front speakers (left front and right front), two channels for a pair of rear surround speakers and a low frequency channel for a sub-woofer. In some embodiments, the computing device 100 determines whether the raw audio data 115 it receives comes from a surround sound configuration by finding a pair of stereo channels and a low frequency sub-woofer channel. FIG. 2*b* illustrates an example of this surround sound identification process in seven stages 251-257.

Figure 2B:
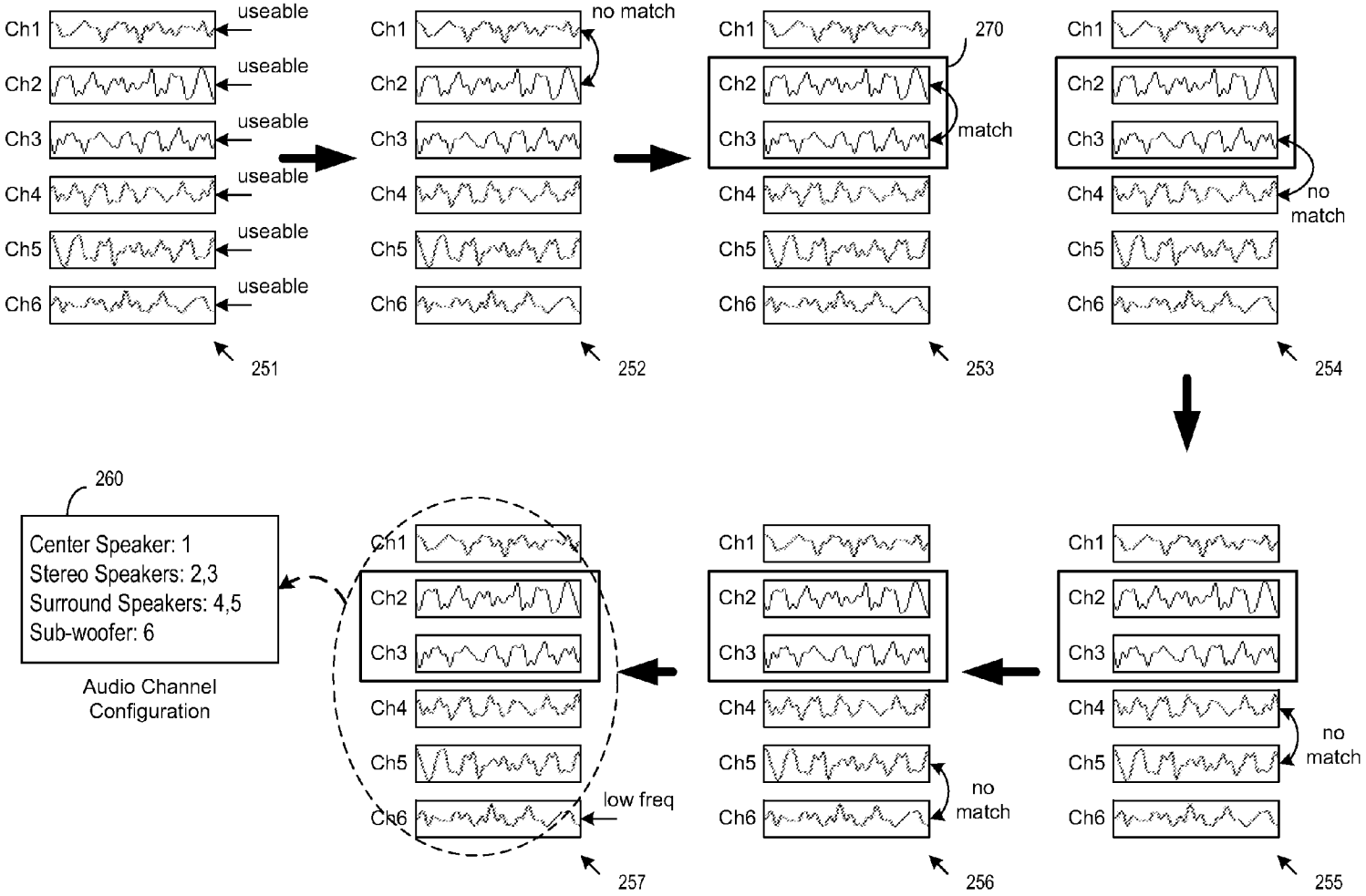
FIG. 2*b* illustrates an example audio channel configuration operation that detects a surround sound configuration.

At stage 251 of FIG. 2*b*, six channels of audio data are presented to the computing device 100. All audio channels ("Ch1", "Ch2", "Ch3", "Ch4", "Ch5" and "Ch6") have valid audio content and are tagged as "useable" by the audio detector module 130. If only five or less channels are determined as having useable audio content, the computing device 100 of some embodiments would immediately determine that the channels do not belong to a six-channel surround sound configuration. If the number of channels having valid audio content is sufficient for the surround sound configuration, the computing device 100 will continue to determine whether the channels do indeed constitute a surround sound configuration.

At the second stage 252, the computing device 100 compares "Ch1" with "Ch2" and receives an indication that "Ch1" and "Ch2" do not match. At the third stage 253, the computing device 100 compares "Ch2" with "Ch3" and receives an indication that "Ch2" and "Ch3" match. Thus, "Ch2" and "Ch3" form a stereo pair, as denoted by the rectangle 270 at the third stage 253.

At the fourth stage 254, the computing device 100 compares "Ch3" with "Ch4" and receives an indication that "Ch3" and "Ch4" do not match. At the fifth stage 255, the computing device 100 compares "Ch4" with "Ch5" and receives an indication that "Ch4" and "Ch5" do not match. At the sixth stage 256, the computing device 100 compares "Ch5" with "Ch6" and receives an indication that "Ch5" and "Ch6" do not match.

At the seventh stage 257, the computing device 100 determines whether there is a sub-woofer channel. In some embodiments, the computing device 100 identifies a sub-woofer channel by searching for a channel that only has frequency components lower than a threshold (e.g., by performing Fast Fourier Transform (FFT) to identify a channel with only frequency components less than 100 Hz). If such a channel exists, the computing device 100 in some embodiments generates an audio channel configuration data 260 that indicates that the six channels belong to a surround group.

In some embodiments, the computing device 100 further examines the positions of the sub-woofer and the stereo pair against known standards of surround-sound systems. If the stereo pair and the sub-woofer are not in the correct channel positions according to a particular surround-sound format, the computing device 100 would not mark the channels as belonging to a surround sound group of that particular surround-sound format. In some of these embodiments, the computing device 100 would report the matching channels "Ch2" and "Ch3" as being a stereo pair and other channels as being mono channels.

Once the audio channel configuration data is available from the audio channel configuration detection operation, as illustrated above in FIG. 2*a* or 2*b*, some embodiments perform assignment of audio channels to speakers using the audio channel configuration data (e.g., the pair of stereo channels to a pair of stereo speakers, the subwoofer channel to the subwoofer speaker, etc). In some embodiments, the user retrieves the audio channel configuration to manually perform the assignment of audio channels. In some embodiments, the computing device 100 or a media editing application automatically uses the audio channel configuration data to perform channel to speaker assignments.

The audio channel configuration detection operation in some embodiments compares only adjacent audio channels (e.g., Ch1 with Ch2, Ch2 with Ch3, etc.), because two channels in a stereo pair are more likely to be adjacent than apart. In some embodiments, the comparison of audio channels is performed for all possible pairings of audio channels. In some of these embodiments, the audio channel configuration detection operation will compare each valid channel with all other valid channels rather than only the adjacent channels (e.g., Ch1 with Ch2, Ch1 with Ch3, Ch1 with Ch4, etc.). In addition, some embodiments compare more than two audio channels at a time rather than always comparing the channels in pairs as shown.

In some embodiments, the audio channel configuration detection operation is performed to detect other configurations of audio channels. For example, the audio channel configuration detection operation can be used to detect a "dual mono" configuration. A dual mono configuration is a channel configuration that has only two audio channels that do not relate to each other. An audio channel configuration detection operation similar to FIG. 2*a* in some embodiments would detect that there are only two audio channels with valid audio content, that these audio channels do not match, and that the audio channels are in a "dual mono" configuration.

Although the example channel configuration detection operations illustrated in FIGS. 2*a* and 2*b* are performed on six channels, one of ordinary skill would recognize that the audio channel configuration detection operation is not limited to six channels. In some embodiments, the operation can detect audio channel configuration from any number of audio channels that is greater or less than six.

The channel configuration detection operation performed by the computing device 100 described above is for detecting the configuration of audio channels at the audio recorder 110. Audio recorders and configurations of audio channels will now be further explained by reference to an example audio recorder 300 of FIG. 3.

Figure 3:
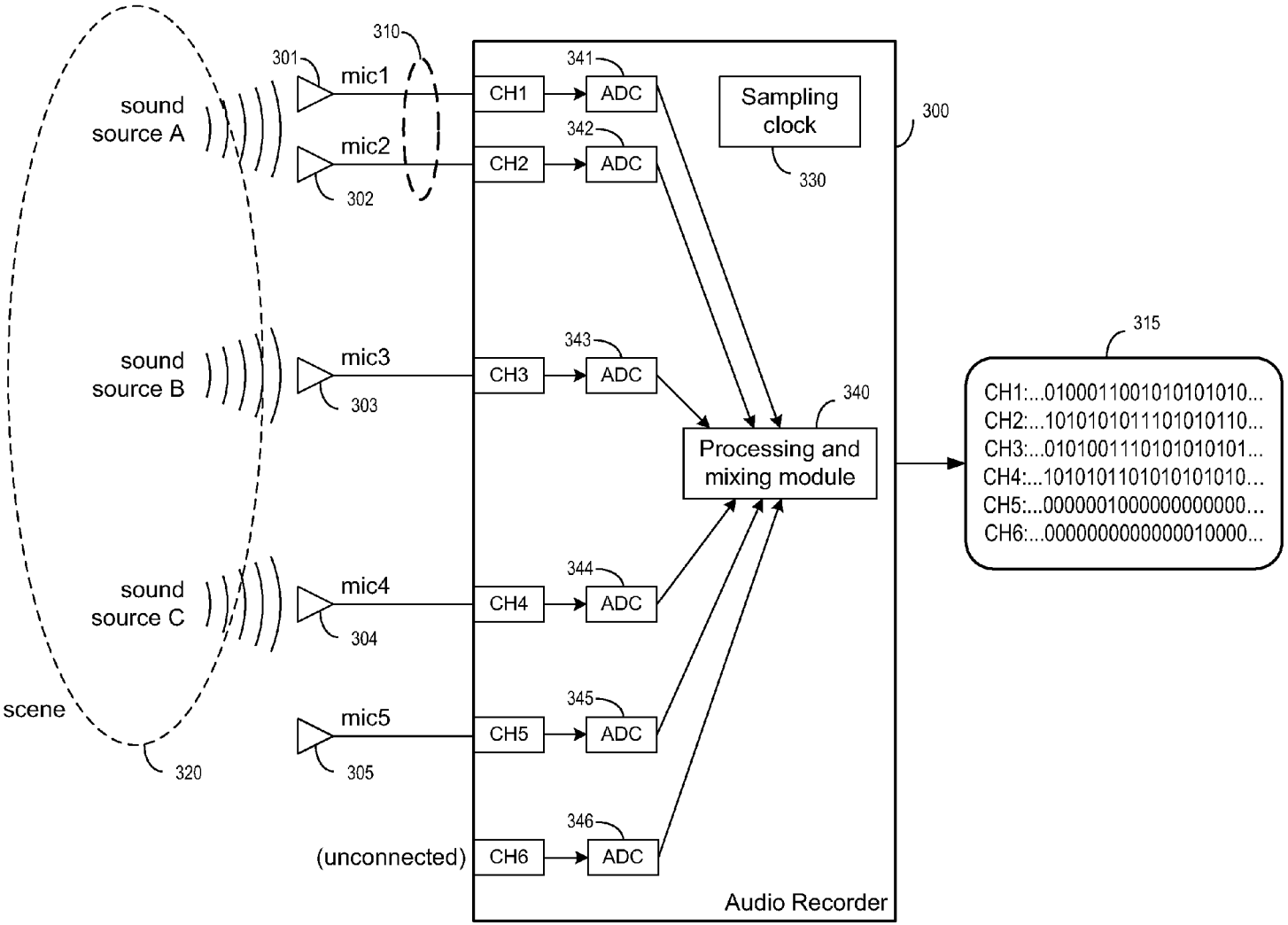
FIG. 3 illustrates an example audio recorder and an example configuration of recording devices.

As illustrated in FIG. 3, the example audio recorder 300 can receive six channels of sound at six channel inputs labeled as "CH1", "CH2", "CH3", "CH4", "CH5" and "CH6". The example audio recorder 300 also includes a sampling clock 330, a processing and mixing module 340, and an array of analog to digital converters (ADCs) 341-346 associated with the channel inputs.

The six channel inputs of the audio recorder 300 can support different configurations of recording devices. FIG. 3 illustrates an example of such configurations of recording devices. In this example configuration, Microphone 301 (mic1) is plugged into the channel input labeled "CH1". Microphone 302 (mic2) is plugged into the channel input labeled "CH2". Microphone 303 (mic3) is plugged into the channel input labeled "CH3". Microphone 304 (mic4) is plugged into the channel input labeled "CH4". Microphone 305 (mic5) is plugged into the channel input labeled "CH5". The channel input labeled "CH6" does not have a microphone plugged in.

The microphones 301-305 receive sound from a scene 320 of audio sources, which can include an orchestra, a movie set, a meeting, or other sound-generating assemblies or entities. The scene 320 includes sound sources A, B and C. Microphones 301 and 302 (mic1 and mic2) are both placed to receive sound from sound source A. Microphone 303 (mic3) is placed to receive sound from sound source B. Microphone 304 (mic4) is placed to receive sound from sound source C. Microphone 305 (mic5) is not placed to receive sound from the scene 320.

In the recording configuration illustrated in FIG. 3, the audio channels produced by microphone 301 will be similar to microphone 302, with differences that are caused by spatial separation of the two microphones. The audio produced by these microphones can be paired together as stereo channels. In some instances, microphones 301 and 302 are part of a single stereo microphone 310 that produces a pair of stereo audio channels.

If microphone 303 is far away from sound source A and C and microphone 304 is far away from sound source A and B, then the audio captured by microphones 303 and 304 will not be closely related to each other or to the audio captured by microphones 301 and 302. In these instances, some embodiments treat the audio channels produced by microphones 303 and 304 as mono channels. An audio channel configuration that includes only a pair of mono channels is sometimes referred to as a "dual mono" recording.

The ADCs 341-346 are for converting audio signals received from each of the channel inputs to a digital form (e.g., binary). The digitized audio from the ADCs 341-346 are sent to the processing and mixing module 340 for generating raw audio data 315. The ADCs 341-346 and the processing mixing module 340 operate according to the sampling clock 330. Specifically, each ADC generates a new audio sample for an audio channel at each rising and/or falling edge of the sampling clock 330, and the process and mixing module 340 stores the newly generated audio samples from the ADCs 341-346 at each rising and/or falling edge of the sampling clock 330.

Since the audio signals are sampled and stored at edges of the sampling clock 330, the clock rate of the sampling clock 330 is also the sampling rate of the digitized audio. In some embodiments, the sampling rate information is available in the raw audio data (e.g., written into the raw audio data 315 by the processing and mixing module 340) and can be extracted and used by the audio channel configuration detection operation. In some embodiments, the sampling rate is specified by a known standard and does not need to be extracted from the raw audio data 315.

Figure 4:
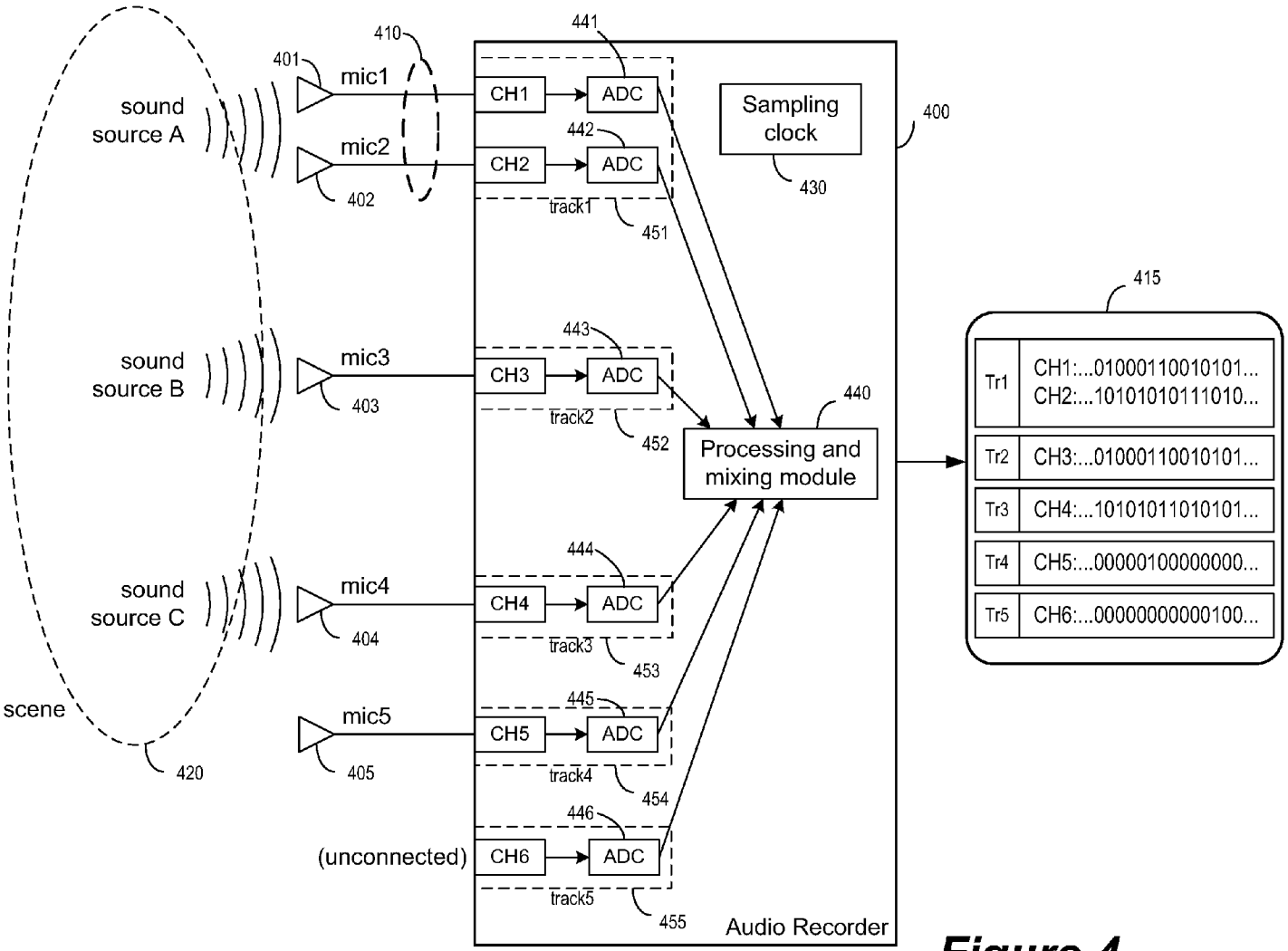
FIG. 4 illustrates an example audio recorder that divides audio channels into tracks.

In some embodiments, the configuration of audio channels is partially determined by factors other than the placement of microphones relative to sound sources. For example, audio channels may have native ordering or inherent organization such as tracks. Such native ordering may be imposed by the audio recorder 300 to reflect actual electrical linkage between channels or imposed by a particular audio file format to reflect a commonly adopted convention for assigning audio channels. In some embodiments, the native ordering can manifest as layouts of audio files, or as names of tracks, channels or audio files, etc. In some of these embodiments, the native ordering of channels (imposed by the audio recorder or by the audio file format) can be an indication of which audio channels are likely related. FIG. 4 illustrates an example audio recorder 400 that divides audio channels into groups (i.e., tracks).

As illustrated, the audio recorder 400 is similar to the example audio recorder of 300 of FIG. 3. The audio recorder 400 has six channel inputs labeled "CH1", "CH2", "CH3", "CH4", "CH5" and "CH6" for capturing sound into six audio channels. Microphones 401-405 are plugged into five of the channel inputs for recording sounds from a sound scene 420. The audio recorder 400 includes six ADCs 441-446 for the six audio channels. The audio recorder 400 also includes a processing and mixing module 440 for generating a raw audio data file 415.

Unlike the audio recorder 300 of FIG. 3, the audio recorder 400 associates audio channels with tracks. As illustrated, "CH1" and "CH2" are associated with track 1, "CH3" is associated with track 2, "CH4" is associated with track 3, "CH5" is associated with track 4, and "CH6" is associated with track 5.

The audio recorder 400 generates a raw audio data 415. FIG. 4 illustrates the raw audio data 415 as including audio data for six audio channels, where audio channels "CH1" and "CH2" are designated as belonging to track 1 and audio channels "CH3", "CH4", "CH5" and "CH6" are designated as belonging to tracks 2, 3, 4 and 5 respectively. In some embodiments, such designations are actually present in the raw audio data 415 as metadata (as a field or as a data structure) so the channel configuration detection operation can extract the information from the raw audio data 415 directly. In some other embodiments, the designation of tracks is not actually present in the raw audio data 415 and the channel configuration detection operation has to obtain the information elsewhere (e.g., from an operating system that is aware of the type of audio recorder being used.)

As mentioned earlier, the native ordering of channels can be an indication of relatedness between channels. In some embodiments, the audio channel configuration detection operation uses such indications to adjust the determination of whether two audio channels are a matching pair. Specifically, two audio channels in the same track are treated as more likely to be in a matching pair than two audio channels in different tracks. Examples of how the audio channel configuration detection operation uses the native ordering of audio channels for determination of pairing will be further described below by reference to FIG. 20.

Having described examples of audio recorders and configurations of audio channels, the channel configuration detection operation performed by a computing device such as device 100 will now be described. For some embodiments, FIG. 5 conceptually illustrates a process 500 for detecting audio channel configuration by analyzing raw audio data. The audio channel configuration detection process 500 will be described by reference to the computing device 100 of FIG. 1.

The process 500 starts when the computing device receives a command to detect audio channel configuration of a given raw audio data. In some embodiments that incorporate the audio channel configuration detection operation as part of a media editing application, this command can be an action initiated by a user, such as when the user selects a GUI object associated with activating the channel configuration detection operation.

Figure 5:
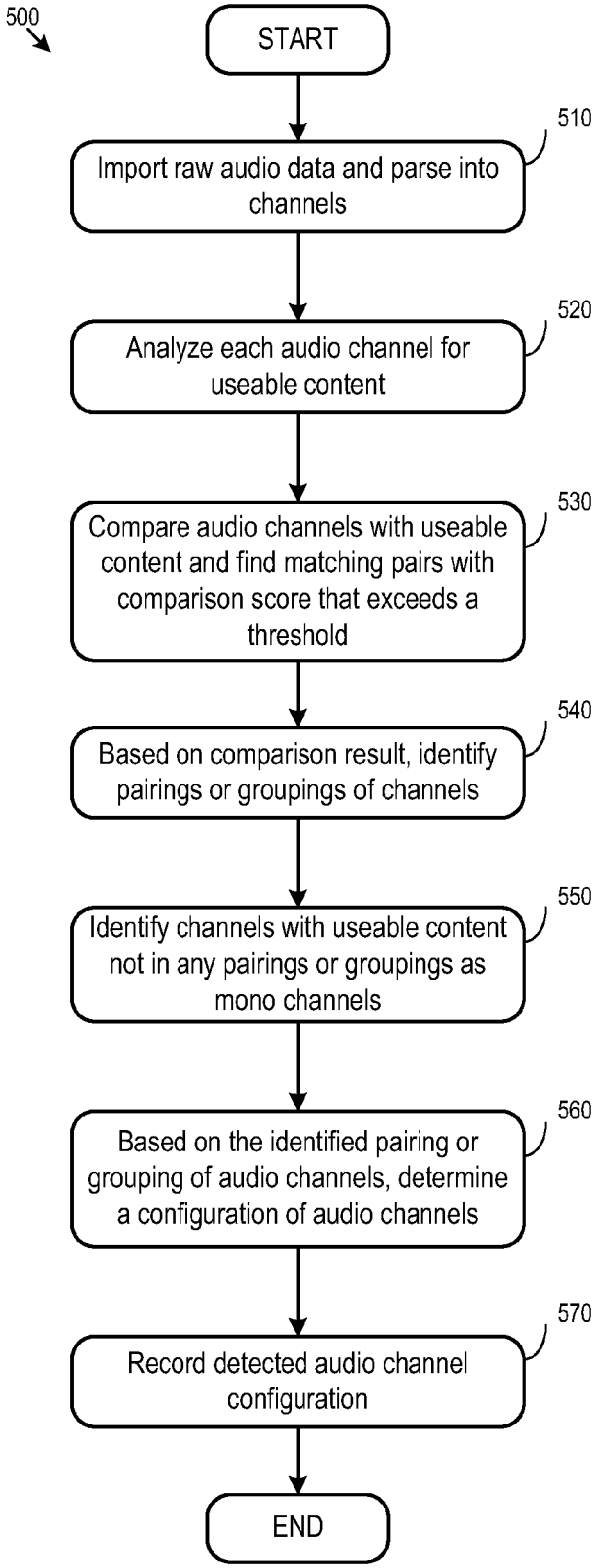
FIG. 5 conceptually illustrates a process for detecting audio channel configuration by analyzing raw audio data.

As shown in FIG. 5, the configuration detection process imports (at 510) raw audio data and parses the imported audio data into channels. The process retrieves the raw audio data from a recording storage (such as 112 of FIG. 1) and parses the audio data into a format that can be used by the rest of the configuration detection process. In some embodiments, this operation is performed by an audio import module such as 120 of FIG. 1.

After importing and parsing the raw audio data, the process analyzes (at 520) each audio channel to determine which audio channels contain useable content and which audio channels do not. In some embodiments, this operation is performed by an audio detector module such as 130 of FIG. 1. The operation for detecting useable content in an audio channel will be further described below by reference to FIGS. 6 and 7. In some embodiments, this operation is performed as a process that will be described below by reference to FIG. 6.

Next, the process compares (at 530) audio channels with useable content and finds matching pairs with comparison scores exceeding a threshold. In some embodiments, only audio channels that have been determined to contain useable content in 520 are selected and paired for comparison. Based on the comparison, the process generates a comparison score for each selected pair of audio channels. If the comparison score exceeds a threshold, the two audio channels being compared are marked as being a matching pair. In some embodiments, this operation is performed by an audio signal comparator module such as 150 of FIG. 1. The operation to compare audio channels will be further described below by reference to FIG. 8.

After comparing audio channels to find matching pairs, the process identifies (at 540) pairings or groupings of channels based on the comparison results. An example of such an operation is illustrated above in FIG. 2*a*, where "Ch5" and "Ch6" are identified as a stereo pair because the comparison of "Ch5" with "Ch6" yields a comparison score that satisfies a threshold and results in a matching indication. Some embodiments join all audio channels with contents that match as a group, while some other embodiments only find pairings of audio channels and not groupings of three or more audio channels. Some embodiments find additional pairings of audio channels, while some other embodiments find only one pairing of audio channels. In some embodiments that find only one pairing of audio channels, the pairing of audio channels with a comparison score higher than all other pairings will be marked as a pair of stereo channel.

Next, the process identifies (at 550) channels with useable content that does not match any other audio channel pairings or groupings as mono channels. The process next determines (at 560) a configuration of audio channels based on the identified pairing or grouping of audio channels. Examples of such an operation are illustrated above in FIGS. 2*a* and 2*b*. In the example illustrated in FIG. 2*a*, the process finds "Ch5" and "Ch6" to be a matching pair of audio channels and determines that the audio channels are in a configuration that includes a pair of stereo channels at channels "Ch5" and "Ch6". In the example illustrated in FIG. 2*b*, the process finds "Ch2" and "Ch3" to be a matching pair, "Ch6" to be a low frequency channel within frequency range of a sub-woofer, and determines that the audio channels are in a surround sound configuration.

After determining the configuration of audio channels, the process records (at 570) the detected configuration in a storage device (such as the device storage 160 of the computing device 100) for later use by another process or operation. After storing the detected channel configuration, the process 500 ends.

Several more detailed embodiments of the invention are described below. Section I describes the operation of detecting valid audio content. Section II then describes in further detail the operation of detecting matching audio channels. Section III describes a media editing application that performs audio channel configuration detection. Finally, Section IV describes an electronic system with which some embodiments of the invention are implemented.

I. Detecting Valid Audio Content

As mentioned above, not all channel inputs of a sound recording device have a microphone plugged in. In these instances, the audio data generated by the audio recorder corresponding to these unplugged audio channels would not contain useful or valid audio content. In order to avoid performing computationally expensive operations (such as comparing two audio channels for matching pairs) on channels that have no valid or useful audio content, some embodiments initially detect valid audio content in audio channels to determine which audio channels have valid or useful audio content.

Figure 6:
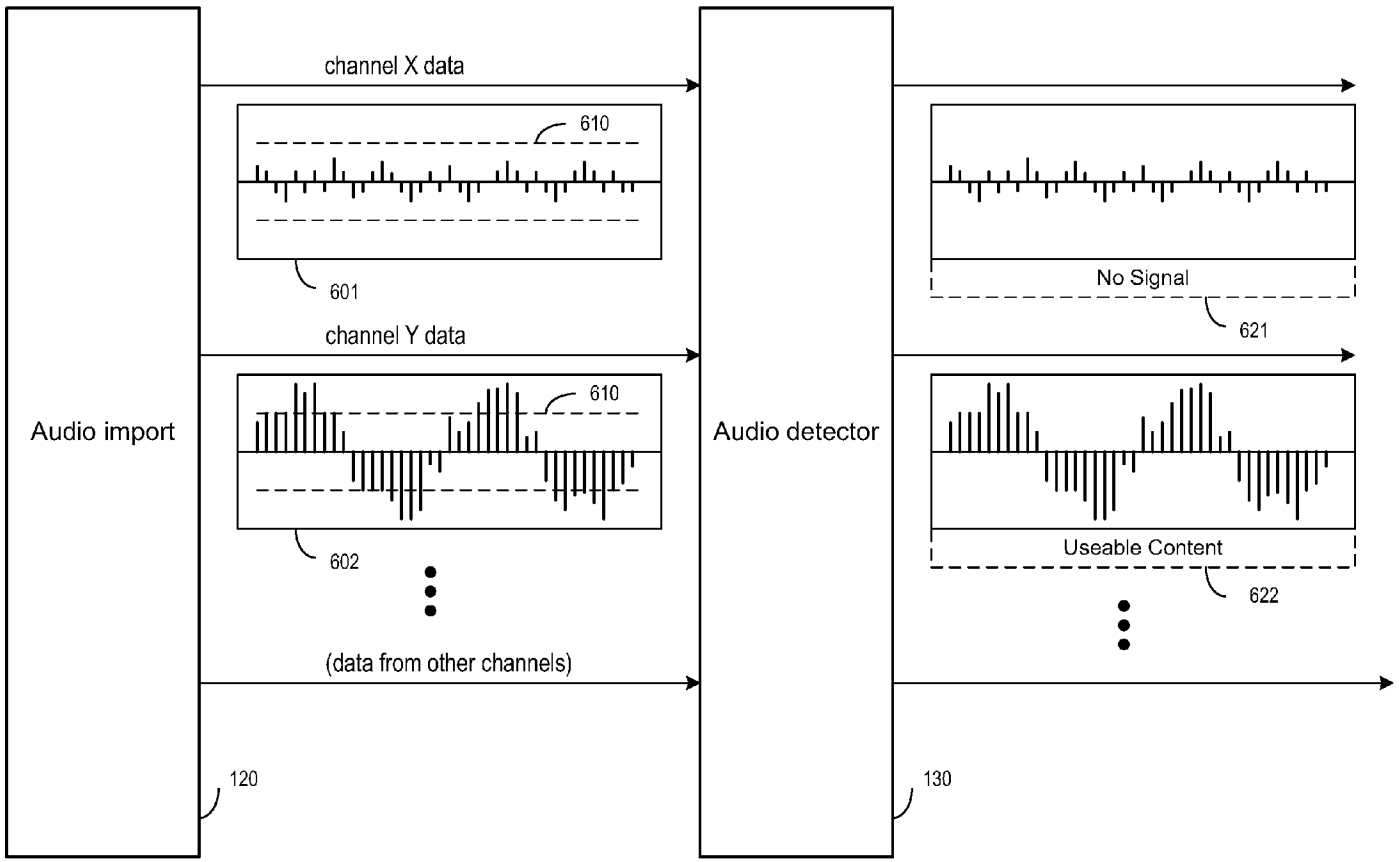
FIG. 6 illustrates an example valid audio detection operation.

FIG. 6 illustrates an example valid audio detection operation. In some embodiments, such an operation is performed at 520 of the process 500 in FIG. 5. The valid audio detection operation is illustrated in FIG. 6 by referencing the audio import module 120 and the audio detector module 130 of the computing device 100 of FIG. 1.

As illustrated, the audio import module 120 has processed raw audio data and parsed out audio data for several audio channels, including channels X and Y. Data for channel X, channel Y, and other channels are passed to the audio detector module 130. Channel X data contains audio signal 601. Channel Y data contains audio signal 602. The audio detector 130 compares audio signals 601 and 602 against a floor level 610 and generates tags 621 and 622 to indicate whether channels X or Y contain valid or useful audio content. In some embodiments, tags 621 and 622 are signals generated by the audio detector 130 to other modules of the computing device 100. In some embodiments, tags 621 and 622 are data bits stored together (e.g., appended) with their respective channel data.

One of ordinary skill would recognize that the audio detector module 130 detects valid audio content and generates tags for other channels as well, and that audio detector 130 can be implemented to perform valid content detection for several channels at once or one channel at a time.

The floor level 610 is a signal level below which an audio signal is considered to not contain valid or useful audio content. In some embodiments, the floor level audio is fixed at a predetermined value (e.g., −40 dB or −60 dB from a reference sound pressure level). In some embodiments, the floor level audio is determined based on the characteristics of the channel, as each channel is expected to include a certain level of background noise. Characteristics of the channel that can contribute to background noise levels include the sampling frequency of the channel, parasitic electrical elements in the analog and mixed signal portions of the channel, interference by other electrical components in the system, etc. In some of these embodiments, each channel has its own floor level based on its own characteristics.

In some embodiments, the determination of the floor level audio is based on an examination of the audio data in the channel itself, such as by calculating the lowest continuous level of audio in the audio channel. The lowest continuous level of audio in some embodiments is calculated as the audio level of a section of the audio of at least a threshold duration that is lower than all other sections of the audio of at least the threshold duration. The audio level of a section of the audio is calculated, in some embodiments, as the root mean square value (RMS) of the audio samples in the section of the audio.

(The RMS value for samples $x_0, x_1, x_2 \ldots x_{n-1}$ is calculated as $$\sqrt{\frac{x_0^2 + x_1^2 + x_2^2 + \cdots + x_{n-1}^2}{n}}.)$$

As illustrated in FIG. 6, the audio signal of channel X is below the floor level 610. The audio detector 130 accordingly produces the tag 621 to indicate that channel X does not have valid signal. On the other hand, the audio signal of channel Y is above the floor level 610. The audio detector 130 accordingly produces the tag 622 that indicates that channel Y does contain useable or valid content.

Figure 7:
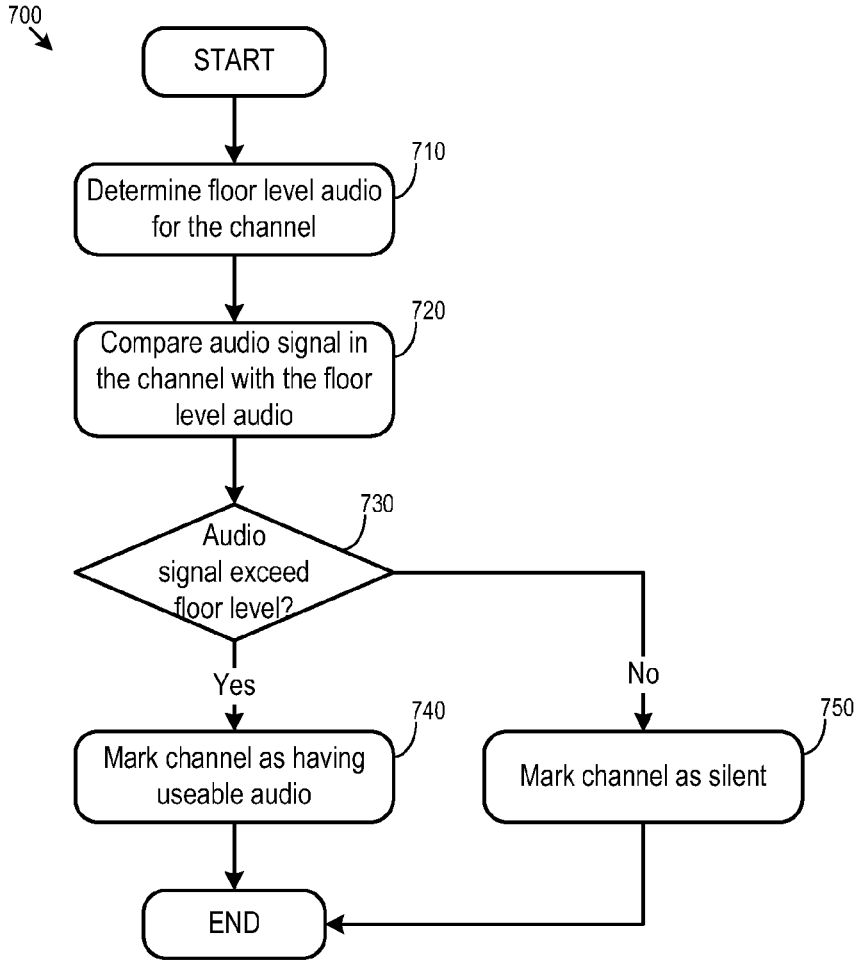
FIG. 7 conceptually illustrates a process for determining whether a channel has useful or valid audio content.

For some embodiments, FIG. 7 conceptually illustrates a process 700 for determining whether a channel has useful or valid audio content. The process 700 will be described by reference to FIG. 6.

The process 700 starts after the audio channel has been parsed and imported from a raw audio data into a format that can be processed by the channel configuration operation. The process determines (at 710) a floor level audio (such as the floor level 610) for the channel. As mentioned above, some embodiments predetermines a floor level audio either using a fixed value or by analyzing the channel characteristics. Some embodiments determine the floor level by examining the audio data in the channel.

Next, the process compares (at 720) the audio signal of the audio channel against the floor level audio determined at 710. The process then examines (at 730) whether the audio signal exceeds the floor level. If the audio exceeds the floor level, the process proceeds to 740. If the audio does not exceed the floor level, the process proceeds to 750.

At 740, the process 700 marks (e.g., generates a tag for) the channel as having valid audio content so the channel will be processed in future operations (e.g., comparison operations). At 750, the process 700 marks the channel as silent or not having valid audio content so the channel will be eliminated from future audio processing operations. After marking the channels as either valid (at 740) or not (at 750), the process ends.

In some embodiments, the audio detector module 130 does not directly compare the amplitude of audio signals against a threshold for valid audio data detection. The audio detector 130, in some of these embodiments, applies a low-pass filter (e.g., computing a running average) to the audio signal and compares the low-pass filtered audio signal against the threshold. This is done to avoid false detection of audio signals due to occasional noise spikes in some embodiments.

II. Detecting Matching Audio Channels

In order to find matching pairs of audio channels for detecting audio channel configuration, the channel configuration detection operation in some embodiments selects pairs of channels for comparison to see if they are indeed a matching pair. Since two audio signals that match each other are similar to each other, but not necessarily identical (e.g., audio signals in a pair of stereo channels are similar but not identical), some embodiments determine matching by quantifying the degree of similarity between audio channels. In some embodiments, this is done by generating a comparison score and determining whether the generated comparison score satisfies a threshold.

Figure 8:
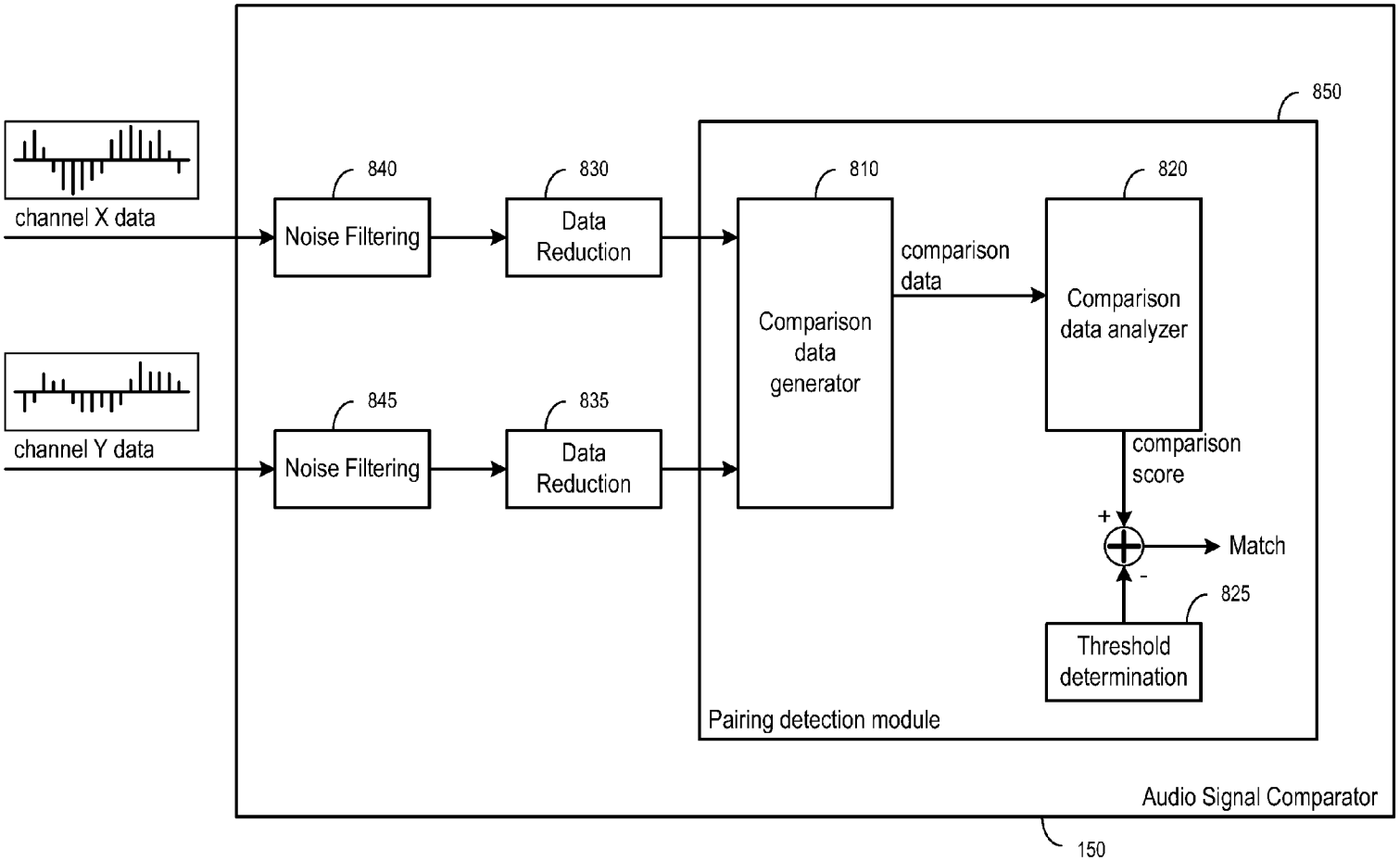
FIG. 8 illustrates an example block diagram for an audio signal comparator module.

FIG. 8 illustrates an example block diagram for the audio signal comparator module 150 of FIG. 1 that compares the audio data of two audio channels for determining whether the two audio channels are a matching pair. As illustrated, the audio signal comparator 150 includes a comparison data generator 810, a comparison data analyzer 820, a threshold determination module 825, and a pair of data reduction modules 830 and 835. In some embodiments, the audio signal comparator 150 also includes a pair of noise filtering modules 840 and 845. The comparison data generator 810, the comparison data analyzer 820, and the threshold determination module 825 are in a pairing detection module 850 in some embodiments.

As illustrated, the audio signal comparator 150 receives audio data for two channels, channel X and channel Y. In some embodiments, these two channels are selected by the grouping manager 140 of the computing device 100. The data from these two channels passes through data reduction modules 830 and 835 before reaching the pairing detection module 850 to be compared by the comparison data generator 810. In some embodiments, the audio data from the two channels is filtered by the noise filter modules 840 and 845 before reaching the data reduction modules 830 and 835. The comparison data generator 810 compares the data from the two channels (after data reduction and/or noise filtering) and generates comparison data. The comparison data analyzer 820 then analyzes the comparison data and generates a comparison score. The audio signal comparator 150 then generates a matching indication by comparing the comparison score against a threshold provided by the threshold determination module 825.

Figure 9:
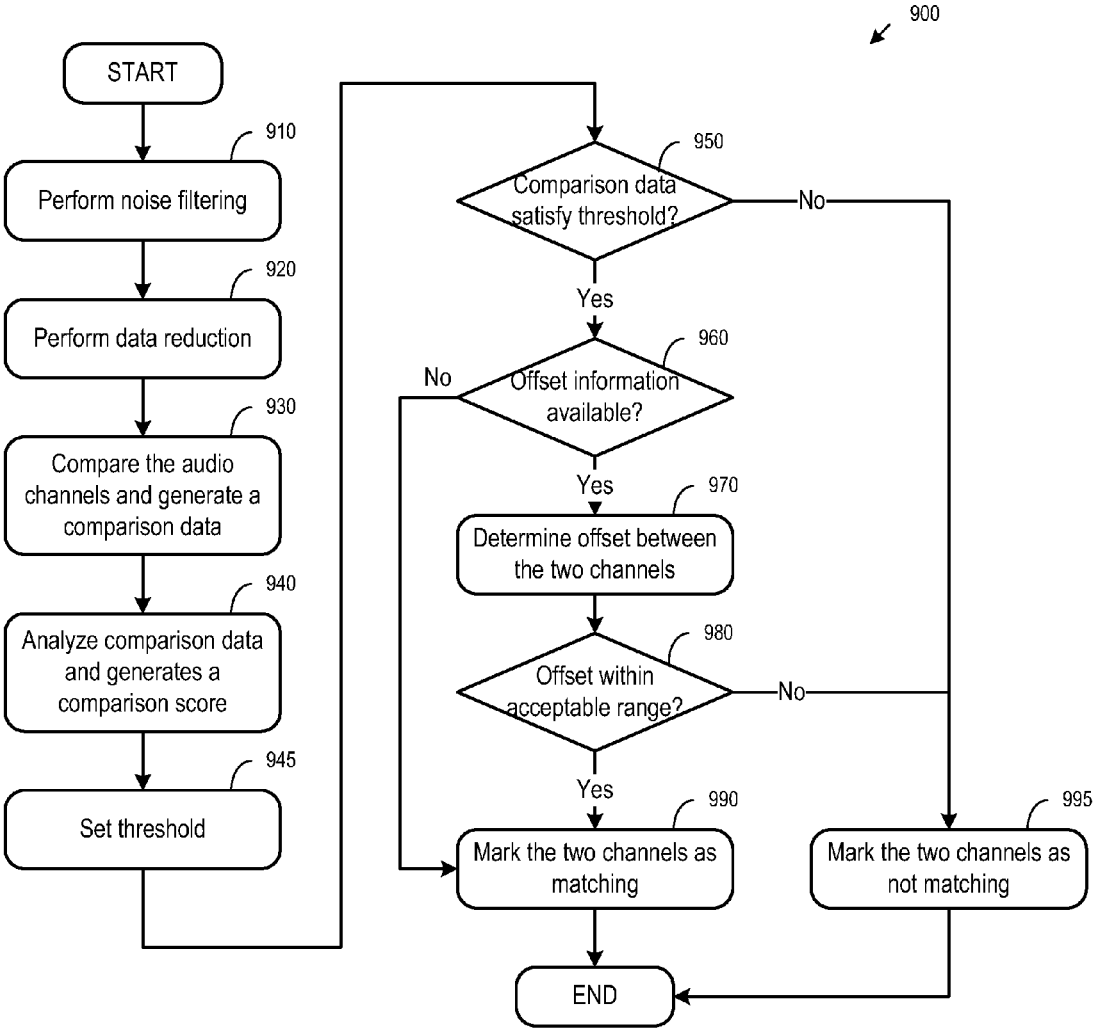
FIG. 9 conceptually illustrates a process for determining whether two audio channels are a matching pair.

For some embodiments, FIG. 9 conceptually illustrates a process 900 for determining whether two audio channels are a matching pair. In some of these embodiments, the process 900 can be performed by the audio signal comparator module 150. Some embodiments perform the process 900 at 530 of the process 500 in FIG. 5.

The process 900 starts when the channel configuration detection operation has selected two audio channels to be compared. The process performs (at 910) noise filtering on the audio data of the selected audio channels. Noise filtering is performed in some embodiments to eliminate noise components from the channel that can interfere with the operation of detecting matching audio channels. Noise filtering is further described below by reference to FIG. 10.

Next, some embodiments perform (at 920) data reduction on the audio data of the selected audio channels. Data reduction reduces the number of samples in the audio data to be compared in order to save computation time. Some embodiments perform data reduction by applying a low pass filter to the data in the selected audio channels. Data reduction is further described below by reference to FIG. 11.

After performing noise filtering and data reduction operations on the selected audio channels, the process compares (at 930) the two audio channels and generates comparison data based on a comparison of the audio data contained in the two channels. Different embodiments perform the comparison and generate the comparison data differently. Some embodiments perform zero crossing analysis for comparing the two channels. Some other embodiments perform cross correlation or phase correlation of the two channels. Comparison of channels based on zero crossing analysis is further described below by reference to FIGS. 12-16. Comparison of channels based on cross correlation or phase correlation will be described below by reference to FIGS. 17-19.

After generating comparison data based on the comparison of the two channels, the process analyzes (at 940) the comparison data and generates a comparison score. Next, the process sets (at 945) a threshold value for comparison against the comparison score. In some embodiments, the process dynamically sets the threshold by examining the comparison data. In some embodiments, the process further adjusts the threshold value according to other considerations such as native ordering of the channels. The setting and adjusting of the threshold value will be further described below by reference to FIGS. 19 and 20.

The process next determines (at 950) whether the comparison score satisfies the threshold value. In some embodiments, the determination of whether the contents of the two channels match is based on whether the comparison score satisfies or exceeds the threshold. If the comparison data satisfies the threshold, the process proceeds to 960. If the comparison data does not satisfy the threshold, the process proceeds to 995.

The process determines (at 960) whether a timing offset is available for determining whether the two channels match. Two channels with content that are sufficiently similar may have a timing offset in between. If the two channels are temporally too far apart, they cannot be a matching pair even if they have otherwise identical audio content. In some embodiments, the operations to generate and analyze comparison data (performed at 930 and 940) also detect a timing offset between the two audio channels. For example, in some embodiments that use cross correlation or phase correlation for comparing the two channels, the correlation operation produces a timing offset between the two channels. If timing offset information is not available (e.g., when comparison of audio channels is based on zero crossing analysis), the process proceeds to 990 to mark the two channels as matching and ends. If timing offset information is available, the process proceeds to 970 and determines the timing offset between the two channels. An example of timing offset determination will be further described by reference to FIG. 19 below.

After determining the timing offset between the two channels, the process 900 determines (at 980) whether the timing offset is within an acceptable range. Two channels in a stereo pair necessarily share a timing offset due to spatial separation of the microphones that produces the stereo pair. However, if the timing offset between the two channels is too great, the two channels cannot possibly be a stereo pair. If the timing offset is within an acceptable range for a pair of stereo channels, the process proceeds to 990. If the timing offset between the two channels is not within an acceptable range such that the two channels cannot possibly be a stereo pair, the process proceeds to 995.

The process marks (at 990) the two channels as being a matching pair for the audio channel configuration operation. The process marks (at 995) the two channels as not being a matching pair. For embodiments that includes the audio comparator module 150 and the grouping manager module 140, the matching indication is used by the grouping manager module 140 to generate the channel configuration data 145 as described earlier by reference to FIG. 2*a*. After generating the matching pair indication for the two channels, the process 900 ends.

The noise filter operation described in 910, the data reduction operation described in 920, and the channel comparison and analysis operations described in 930-980 will be further described below by reference to modules in FIG. 8.

A. Noise Filtering

Noise filtering is performed in some embodiments to eliminate noise components from the channel that can interfere with the operation of detecting matching audio channels. The audio recorders and microphones that produce the audio data often include analog or mixed signal components (such as physical wires and ADCs) that are vulnerable to electrical interference. Electrical interference can come from parasitic electrical elements in the analog and mixed signal portions of the channel, or from other electrical components in the system. The sampling clock of the ADC, for example, is a source of noise in some audio recorders. The audio data produced is therefore likely to include noise due to electrical interference. This noise may, in some instances, affect the operation of detecting matching audio channels. It is therefore desirable, in some embodiments, to eliminate at least some of the noise before performing the comparison of audio channels. In some embodiments, noise filtering is performed by noise filtering modules, such as 840 and 845 of FIG. 8. In some other embodiments, the audio channel configuration detection operation does not have noise filter modules and does not perform noise filtering.

The audio channel configuration detection operation in some embodiments has information on noise-causing characteristics of audio channels and can use the information to reduce at least some of the noise. By analyzing these noise-causing characteristics of audio channels, some embodiments create a noise cancellation signal for subtracting noise from the audio channel. Some embodiments use the analysis of the noise-causing characteristics of audio channels to create a filter targeting particular frequency components (e.g., a band-pass filter) that are likely to contain noise. For example, some embodiments of the audio channel configuration operation have information about the sampling frequency of audio channels (e.g., from the raw audio data.) Some of these embodiments thus generate a noise cancellation signal or a band pass filter based on the sampling frequency to cancel or filter some of the noise in the audio channel caused by the sampling clock at the audio recorder.

Figure 10:
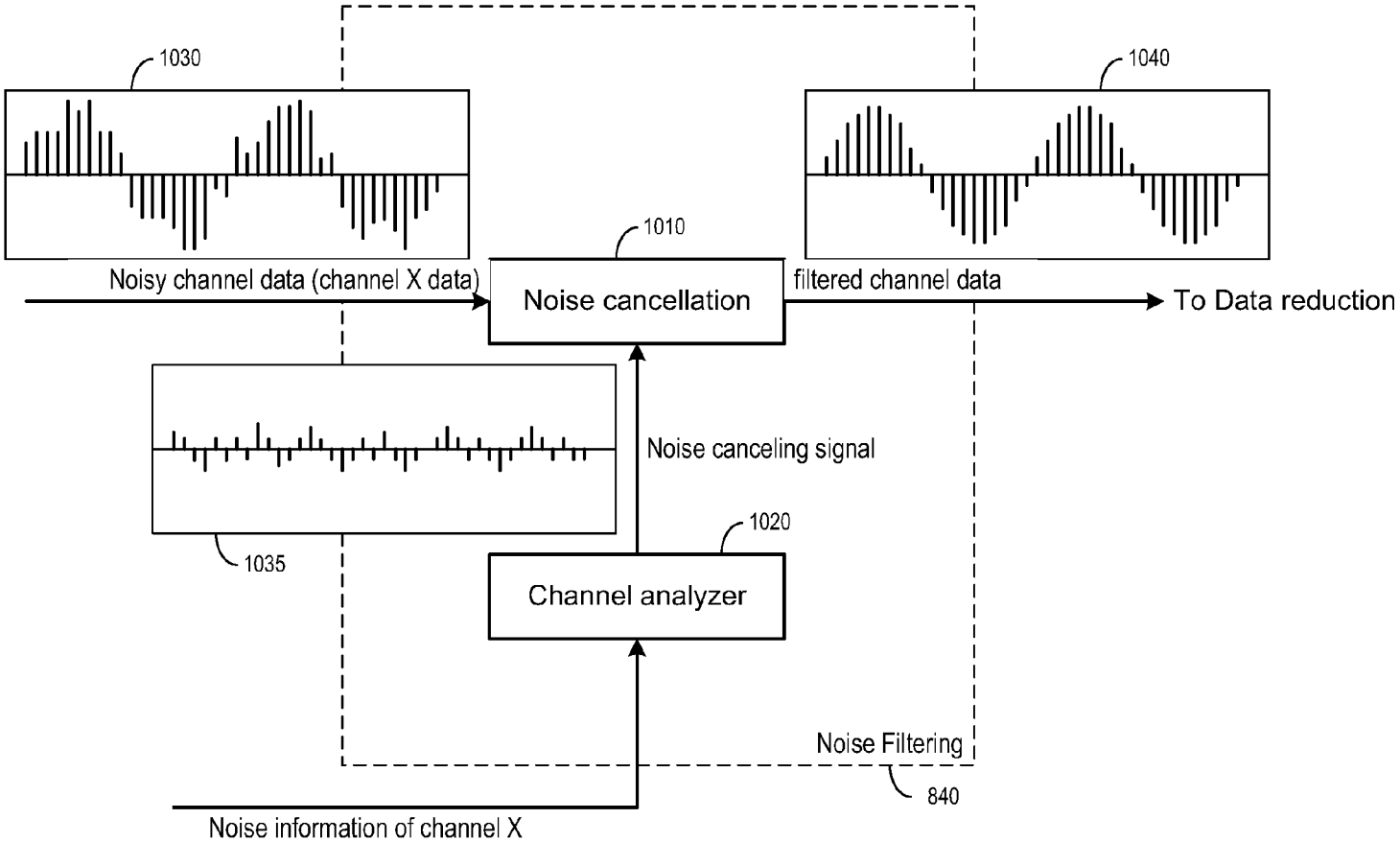
FIG. 10 illustrates an example block diagram of a noise filtering module.

FIG. 10 illustrates an example block diagram of the noise filtering module 840. As illustrated, the noise filtering module 840 includes a noise cancellation module 1010 and a channel analyzer module 1020. The noise-filtering module 840 receives noisy channel data 1030 that includes both signal and noise. The noise filtering module 840 also receives information about the noise of the channel. Such information can include a sampling of the channel without any signal (i.e., only noise), a model of the channel, or any other information that can be used to predict the noise in the channel. The channel analyzer module 1020 processes such information and generates a noise cancellation signal 1035. The noise cancellation module 1010 then uses the noise-canceling signal 1035 to cancel (i.e., subtract) noise from the noisy channel data 1030 and generates filtered channel data 1040.

In some embodiments, the channel configuration detection operation performs data reduction operation by low-pass filtering operations such as down sampling or running averages. Since higher frequency noise components in these embodiments will be filtered by the data reduction operation, some of these embodiments optimize the noise filtering operation by performing noise filtering or canceling against only low frequency noise components.

B. Data Reduction

Digitized audio signals or audio data as generated by an audio recorder can include a large number of audio samples. A large number of samples can be the result of a long recording session and/or the result of a high sampling rate employed at the audio recorder. However, performing audio channel comparison directly on audio data that includes a large number samples is neither desirable nor necessary. For an audio channel configuration detection operation, audio data only needs to include enough samples to distinguish matching channels from non-matching channels. It is not necessary to use every sample for comparison and expend an unreasonable amount of computing time and resources. Some embodiments thus perform data reduction on the audio data by reducing the number of data samples to be compared. In some of these embodiments, such data reduction is performed by modules such as 830 and 835 of FIG. 8.

Figure 11:
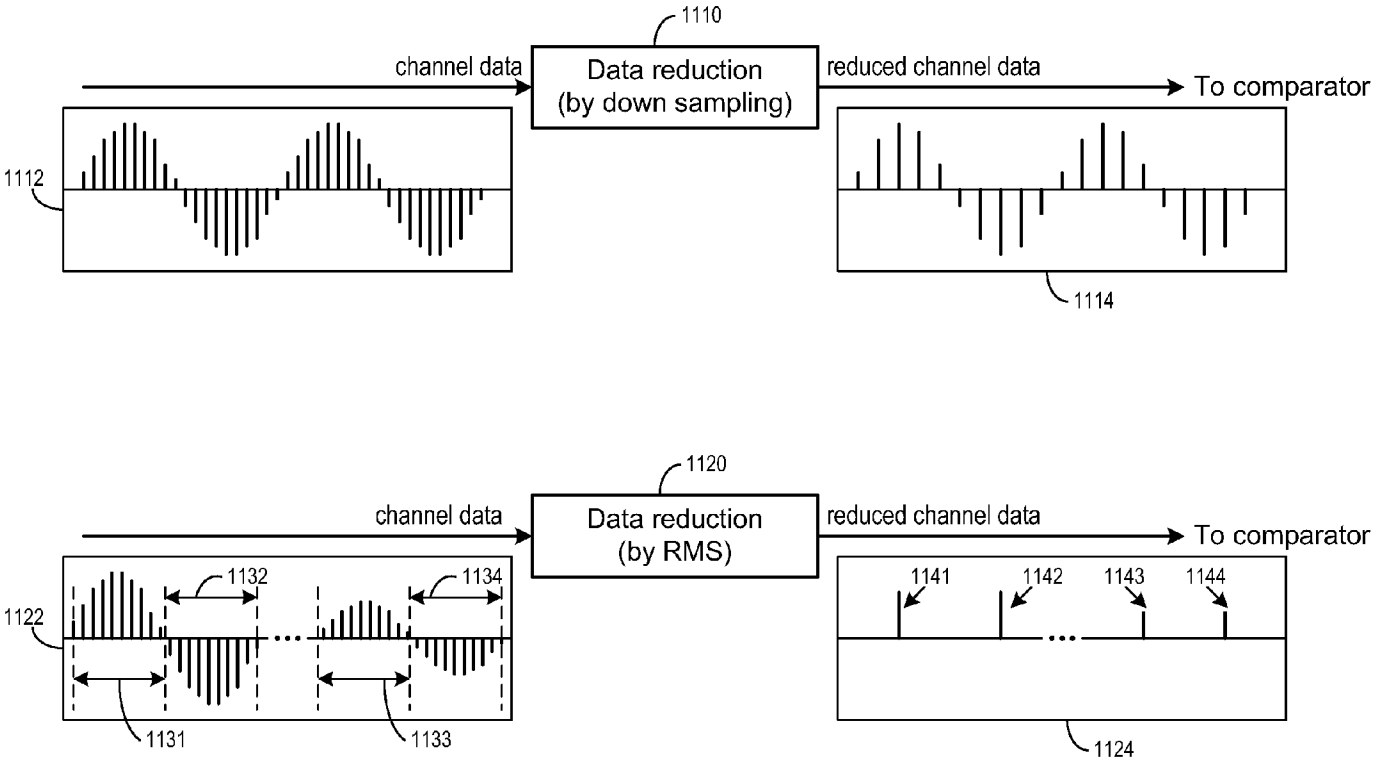
FIG. 11 illustrates two examples of data reduction operations that reduce the size of the audio data.

Different embodiments use different data reduction techniques to reduce the size of the audio data. FIG. 11 illustrates two examples of such data reduction operations. Data reduction operation 1110 operates on audio data 1112 and produces reduced audio data 1114. Data reduction operation 1120 operates on audio data 1122 and produce reduced audio data 1124.

Data reduction operation 1110 is a down sampling operation that reduces the number of samples in an audio channel by reducing the sampling rate of the audio data. As illustrated in FIG. 11, the data reduction operation 1110 receives the original audio data 1112 at a first, higher sampling rate and produces the reduced audio data 1114 at a second, lower sampling rate. The number of data samples used to represent the audio signal is thus reduced to a fraction of the original. If the original audio data 1112 is an audio signal sampled at 48 kHz that includes eight samples {0, 258, 500, 707, 866, 966, 1000, 966}, a down sampling operation 1110 that reduces the sampling rate to 24 kHz would produce a reduced audio data 1114 that includes only four samples {0, 500, 866, 1000} or {258, 707, 966, 966}.

Data reduction operation 1120 is an amplitude tracking operation. An amplitude tracking operation in some embodiments tracks the power or the volume of the audio signal. Some embodiments perform the amplitude tracking operation by computing running averages of channel data at fixed intervals. In some of these embodiments, the running average is based on RMS values. As illustrated in FIG. 11, the data reduction operation 1120 receives the original audio data 1122 at a certain sampling rate. The data reduction operation 1120 computes the RMS values at intervals 1131, 1132, 1133 and 1134 and produces corresponding RMS values 1141, 1142, 1143 and 1144 for these intervals. In some embodiments, the computed RMS values are used as the reduced channel data for detecting matching audio channels. Although intervals 1131-1134 are illustrated as non-overlapping, some embodiments compute running averages (e.g., RMS) based on intervals that do overlap.

Data reduction operations 1110 and 1120 are forms of low pass filtering operations that keep low frequency components of the audio signal while removing higher frequency components of the audio signal. One of ordinary skill would recognize that other low pass filtering operations can also be used to generate audio data with a reduced number of data samples for detection of matching audio channels.

C. Channel Comparison

As mentioned above, some embodiments determine whether two channels are a matching pair by quantifying the degree of similarity between the two audio channels. In some embodiments, this is done by generating a comparison score and determining whether the generated comparison score satisfies a threshold. For the example audio signal comparator 150 of FIG. 8, the comparison data generator module 810 generates the comparison data by comparing the audio data of the two channels and the comparison data analyzer module 820 generates the comparison score by analyzing the comparison data.

As mentioned above, there are different algorithms for performing the comparison of two audio channels. Different embodiments use different comparison techniques based on different algorithms or different combinations of algorithms. Different embodiments implement comparison data generator 810 and comparison data analyzer 820 differently according to different comparison techniques. Sub-section (1) below describes a channel comparison operation based on zero crossing analysis. Sub-section (2) below describes a channel comparison operation based on correlation. Sub-section (3) below describes adjustment of the comparison threshold during a channel comparison operation.

(1) Zero Crossing Analysis

In some embodiments, the comparison of audio channels for the purpose of determining whether two channels are a matching pair is accomplished by performing zero crossing analysis. Using zero crossing analysis for determining whether two audio channels are a matching pair in some embodiments includes (i) generating a zero crossing spectrum for each of the two channels, (ii) comparing the zero crossing spectrums of the two channels and obtaining a comparison score, and (iii) determining whether the two channels are a matching pair by comparing the comparison score against a threshold. In some embodiments, the pairing detection module 850 of FIG. 8 implements zero crossing analysis. In some of these embodiments, the pairing detection module 850 include a comparison data generator 810 that generates the zero crossing spectrums and a comparison data analyzer 820 that generates a comparison score by comparing the zero crossing spectrums.

Figure 12:
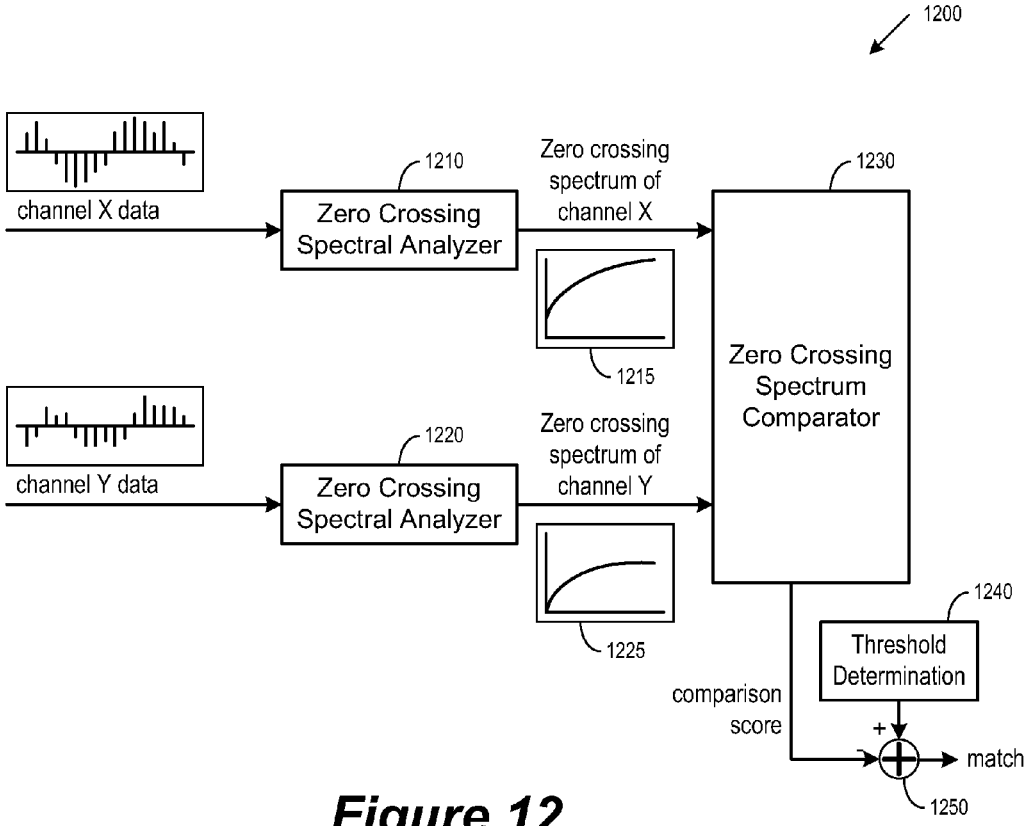
FIG. 12 illustrates an example block diagram of a zero crossing pairing detection module that uses zero crossing analysis for determining matching of audio channels.

For some embodiments, FIG. 12 illustrates an example block diagram of a pairing detection module 1200 that uses zero crossing analysis for determining matching of audio channels. As illustrated in FIG. 12, the pairing detection module 1200 includes zero crossing spectral analyzers 1210 and 1220, zero crossing spectrum comparator 1230, a threshold determination module 1240, and a match indicator 1250. Audio data from a candidate pair of channels (channel X and channel Y) are fed to the zero crossing spectral analyzers 1210 and 1220. Each zero crossing spectral analyzer produces a spectrum (zero crossing spectrum 1215 for channel X and zero crossing spectrum 1225 for channel Y) for the zero crossing spectrum comparator 1230 to compare. Based on the comparison, the zero crossing spectrum comparator 1230 generates a comparison score. If the comparison score satisfies the threshold provided by the threshold determination module 1240, the matching indicator 1250 produces a matching indication. In some embodiments, the determination of whether the comparison score satisfies the threshold is accomplished by using an adder, subtractor, or other arithmetic logic in the match indicator 1250.

One of ordinary skill would recognize that some of the modules illustrated in FIG. 12 can be implemented as one single module performing the same functionality in a serial or sequential fashion. For example, some embodiments implement the zero crossing spectral analyzers 1210 and 1220 as one single zero crossing spectral analyzer that processes channel X data and channel Y data in a sequential manner. In some embodiments, the entire zero crossing pairing detection module 1200 is implemented as a software module of a program being executed on a computing device.

Figure 13:
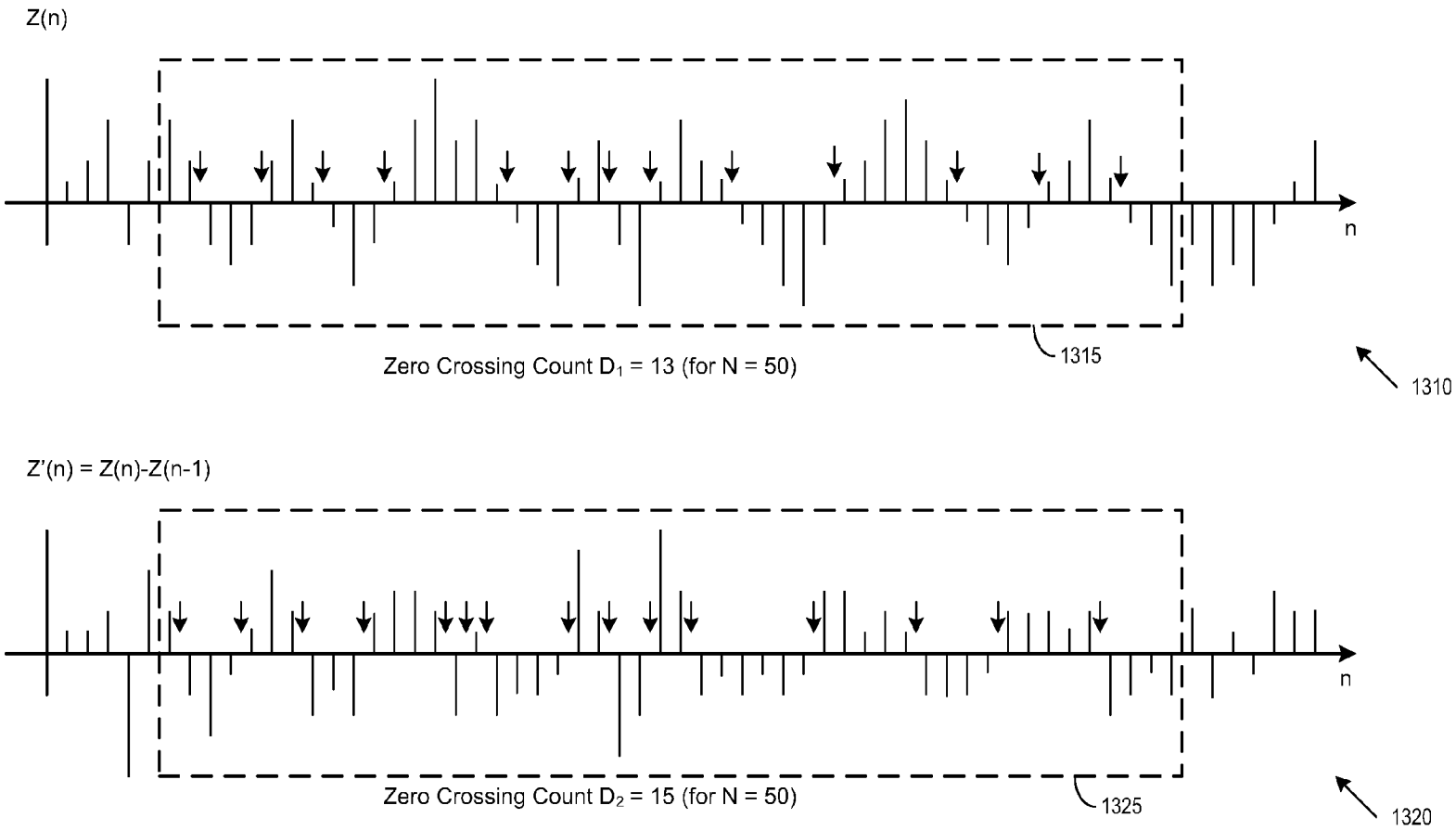
FIG. 13 illustrates an example of zero crossing analysis.
Figure 14:
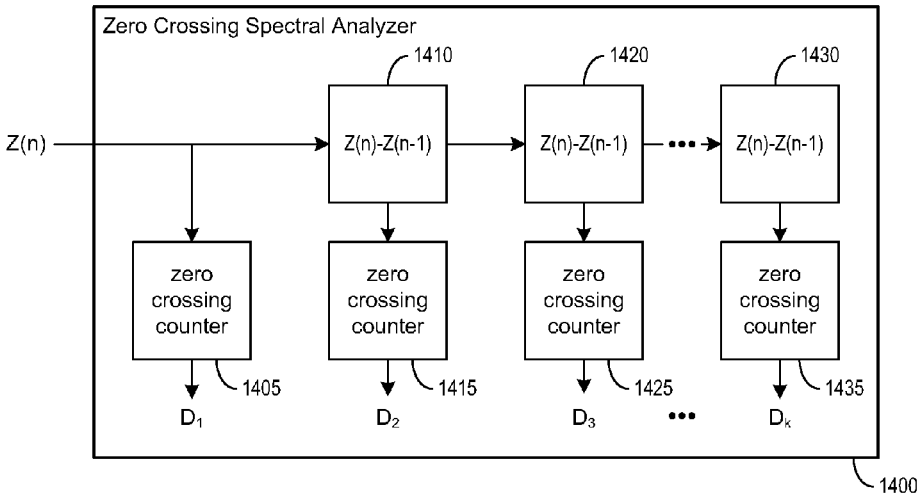
FIG. 14 illustrates an example zero crossing spectral analyzer that recursively applies a difference function to obtain higher order difference functions and higher order zero crossing counts.
Figure 15:
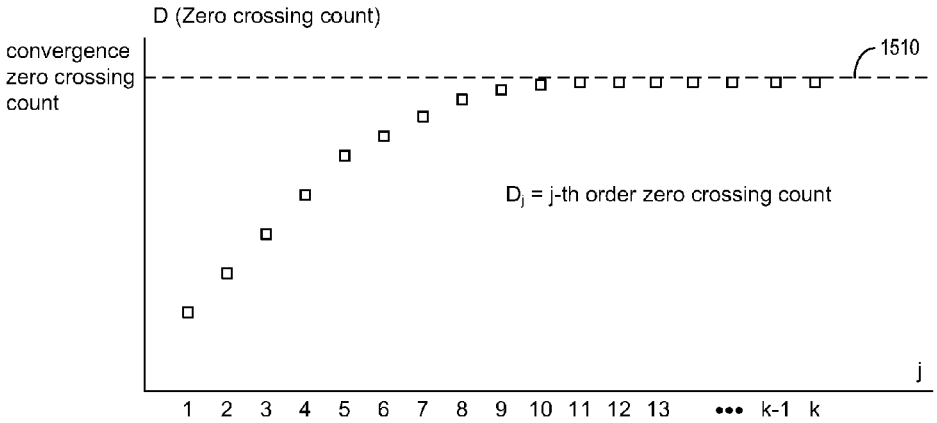
FIG. 15 illustrates an example zero crossing spectrum.

The zero crossing spectral analyzer modules 1210 and 1220 generate the zero crossing spectrums by performing zero crossing analysis on the incoming audio channels (e.g., channel X and channel Y). FIG. 13 below illustrates an example zero crossing analysis. FIG. 14 below illustrates an example zero crossing spectral analyzer module. FIG. 15 below illustrates an example zero crossing spectrum.

FIG. 13 illustrates an example zero crossing analysis in two stages 1310 and 1320. Stage 1310 shows an example discrete signal Z(n) (e.g., contents of audio channel X or audio channel Y) and an example zero crossing count window 1315 that is defined to include 50 samples of Z(n). Within the window 1315, there are 13 occurrences of the signal Z(n) transition from a positive value to a negative value or vice versa (as indicated by little arrows in the figure). In other words, there are 13 zero crossings in the window 1315. Some embodiments refer to this as a zero crossing count D of 13 ($D_1$=13) for Z(n). The choice of zero crossing count window 1315 is different for some embodiments and not necessarily 50. Some embodiments choose larger zero crossing windows (such as 1000 or greater) in order to produce a zero crossing spectrum with a higher degree of precision. Some other embodiments choose smaller zero crossing windows in order to conserve computing resources.

Stage 1320 shows a first order difference function of Z'(n), which is defined as Z(n)-Z(n−1). Thus for example, if Z(6)=4, Z(5)=2 and Z(4)=−2, then Z'(6)=2 and Z'(5)=4. The stage 1320 also shows a window 1325 of 50 samples of Z'(n). Within this window, the function Z'(n) crosses zero (transition between positive and negative) 15 times. Some embodiments refer to this as a zero crossing count D of 15 ($D_2$=15) for the first order difference function Z'(n).

Some embodiments apply the difference function Z(n)-Z(n−1) repeatedly or recursively and obtain a series of zero crossing counts for these higher order difference functions. For example, some embodiments apply the difference function to Z'(n) to obtain Z"(n) (which equals to Z'(n)-Z'(n−1) or Z(n)-2Z(n−1)+Z(n−2)), and count the number of zero crossings for Z"(n) in a window of 50 samples. The operation is then performed recursively to the second order difference function Z"(n) to obtain a third order difference function and a third order zero crossing count, and then to the third order difference function to obtain a fourth order difference function and a fourth order zero crossing count, and so forth. FIG. 14 illustrates an example zero crossing spectral analyzer 1400 that recursively applies the difference function to obtain higher order difference functions and higher order zero crossing counts.

As illustrated in FIG. 14, the zero crossing spectral analyzer 1400 includes a chain of difference function operators Z(n)-Z(n−1) (1410, 1420, and 1430) and a series of zero crossing counters (1405, 1415, 1425, and 1435). The difference operator 1410 operates on Z(n) and produce a first order difference function. The difference operator 1420 operates on the first order difference function produced by the difference operator 1410 and produces a second order difference function, and so forth. A series of difference operators are linked in a chain to produce higher order difference functions, ending with difference operator 1430 producing a k-th order difference function of Z(n).

Zero crossing counter 1405 counts the number of zero crossings ($D_1$) in a given window for the incoming signal Z(n) (i.e., channel X data or channel Y data). Zero crossing counter 1415 counts the number of zero crossings ($D_2$) in the same given window for the first order difference function produced by the first difference operator 1410. Successive zero crossing counters, such as 1425 and 1435, count the number of zero crossings for the same given window for successive higher orders of difference functions, such as 1420 and 1430, to produce zero crossing counts, such as $D_3$ and $D_k$.

One of ordinary skill in the art would recognize that there are many different ways of implementing the zero crossing spectral analyzer 1400. For example, the zero crossing spectral analyzer can be implemented as a software module of part of a media editing application running on a computing device, and the function modules of the zero crossing spectral analyzer can be implemented as sub-routines of the software module. The chain or series of difference function operators 1410-1430 can be implemented as a recursive function call to the same difference function operator sub-routine.

The collection of the zero crossing counts $D_1, D_2, D_3 \ldots D_k$ from the zero crossing spectral analyzer 1400 forms a zero crossing spectrum of the incoming signal Z(n) (i.e., channel X data or channel Y data). FIG. 15 illustrates an example of such a zero crossing spectrum. Each data point (illustrated by a small square) represents a zero crossing count of a higher order difference function. Since the difference function Z(n)-Z(n−1) is a high pass filter, successive application of the difference function Z(n)-Z(n−1) results in higher order difference functions that gradually lose lower frequency components. Each successive application of the difference function keeps only the higher frequency components until only the highest frequency component remains. Since the zero crossing count D of a function Z(n) corresponds to the dominant frequency of the function Z(n), successive zero crossing counts $D_1, D_2, D_3 \ldots D_k$ correspond to the dominant frequencies of successively higher order difference functions of Z(n). The successive zero crossing counts converge to a convergence zero crossing count 1510 that corresponds to the highest frequency component of Z(n).

Since different audio channels have different sets of frequency components and thus different zero crossing spectrums, some embodiments use such zero crossing spectrums to uniquely identify the audio channels. However, since zero crossing counts at higher orders of difference function converge to the convergence zero crossing count, calculating zero crossing counts beyond certain higher order difference functions, where zero crossing counts have already converged, would not yield any additional useful information about the audio channel. Some embodiments therefore limit the number of successive applications of difference functions accordingly. In the example of FIG. 15, the zero crossing counts $D_1$ converge after about j=12. Some embodiments in this instance would choose k (i.e., the index corresponding to the highest order zero crossing count) to be 12, or some number slightly greater than 12, since calculating zero crossing counts for j much greater than 12 would not yield additional useful information. Some embodiments select the number of successive difference functions to be another number (e.g., 20) according to a set of empirical result based on examinations of various audio data.

Figure 16:
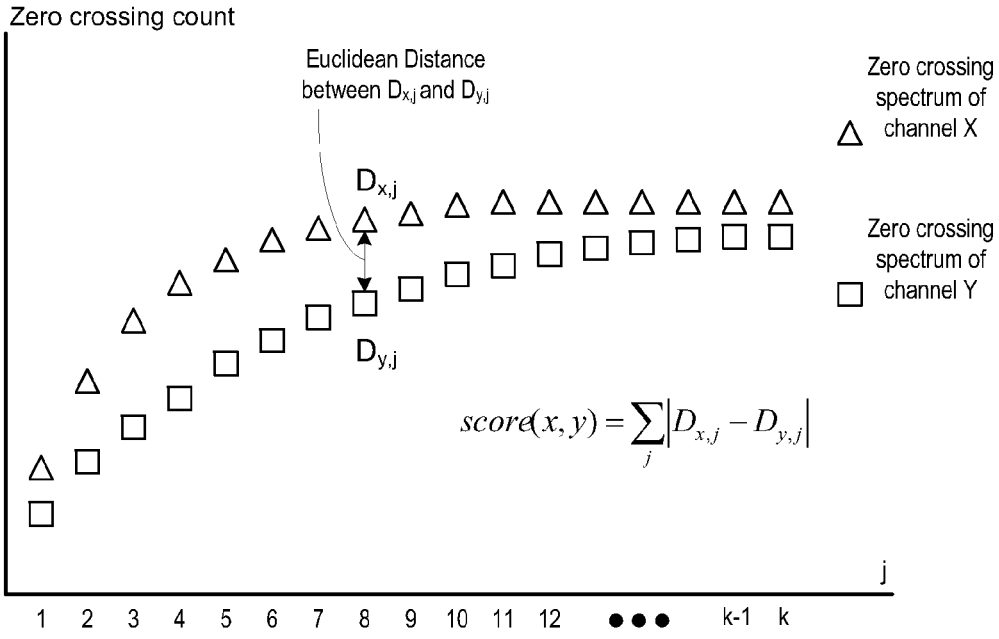
FIG. 16 illustrates an example of using zero crossing spectrums of two audio channels for generating a comparison score.

Some of these embodiments use such zero crossing spectrums to calculate a comparison score for determining whether two channels sufficiently match each other to constitute a stereo pair. As discussed earlier by reference to FIG. 12, some embodiments use a zero crossing spectrum comparator, such as 1230, to compare zero crossing spectrums and to generate a comparison score. FIG. 16 illustrates an example of using zero crossing spectrums of two audio channels for generating a comparison score.

As illustrated in FIG. 16, the zero crossing spectrum of channel X data includes j-th order zero crossing counts $D_{x,j}$ for j=1 to k while the zero crossing spectrum of channel Y data includes j-th order zero crossing counts $D_{y,j}$ for j=1 to k. Some embodiments calculate the comparison score of these two channels as:

$$\text{score}(x, y) = \sum_j |D_{x,j} - D_{y,j}|. \tag{1}$$

In other words, the comparison score is the sum of the Euclidean distances between $D_{x,j}$ and $D_{y,j}$ ($|D_{x,j}-D_{y,j}|$). In some embodiments, the comparison score of these two channels is calculated as:

$$\text{score}(x, y) = \sum_j (D_{x,j} - D_{y,j})^2. \tag{2}$$

In some embodiments, zero crossing counts from different values of j are weighted differently. In some of these embodiments, the comparison score of the two channels is calculated as:

$$\text{score}(x, y) = \sum_j w_j \cdot |D_{x,j} - D_{y,j}|, \tag{3}$$

where $w_j$ is the weight assigned to the j-th order zero crossing count. In some embodiments, this is done to favor certain frequency components of the audio signal during the computation of the comparison score.

(2) Correlation

In some embodiments, the comparison of audio channels to determine whether two channels are a matching pair is accomplished by performing correlation of the audio data (i.e., digitized audio signals) of the two channels. In some embodiments, using correlation to determine whether two audio channels form a matching pair includes (i) generating a correlation function by correlating two sets of audio data corresponding to the two audio channels, (ii) detecting a peak correlation value in the correlation function, and (iii) comparing the peak correlation value to a threshold in order to determine whether the two audio channels sufficiently relate to each other to constitute a stereo pair. In some embodiments, the pairing detection module 850 of FIG. 8 implements correlation. The pairing detection module 850, in some of these embodiments, includes a comparison data generator 810 that generates the correlation function. The pairing detection module 850, in some of these embodiments, also includes a comparison data analyzer 820 that generates a comparison score by detecting the peak correlation value.

A correlation is an operation that measures the similarity between two waveforms as a function of a timing offset applied to one of the two waveforms. In cases where both waveforms are discrete functions (such as the digitized audio data in the audio channels), a correlation function of two discrete waveforms f and g is defined as:

$$\text{correlation}(f, g)(n) \equiv \sum_{m=-\infty}^{\infty} f(m) \cdot g(n+m). \tag{4}$$

For example, if f is audio data of a first audio channel that includes audio samples {1, 2, 3, 4}, and g is audio data of a second audio channel that includes audio samples {1, 2, 2, 1}, then the correlation function between the first and second audio channels is calculated as:

$$\begin{aligned}
&\text{correlation}(-4)=0,\\
&\text{correlation}(-3)=1\times4=4,\\
&\text{correlation}(-2)=3\times1+4\times2=11,\\
&\text{correlation}(-1)=2\times1+3\times2+4\times2=16,\\
&\text{correlation}(0)=1\times1+2\times2+3\times2+4\times1=15,\\
&\text{correlation}(1)=1\times2+2\times2+3\times1=9,\\
&\text{correlation}(2)=1\times2+2\times1=4,\\
&\text{correlation}(3)=1\times1=1.
\end{aligned} \tag{5}$$

The correlation function illustrated in equation (5) has a peak correlation value of 16 at a timing offset of −1.

Figure 17:
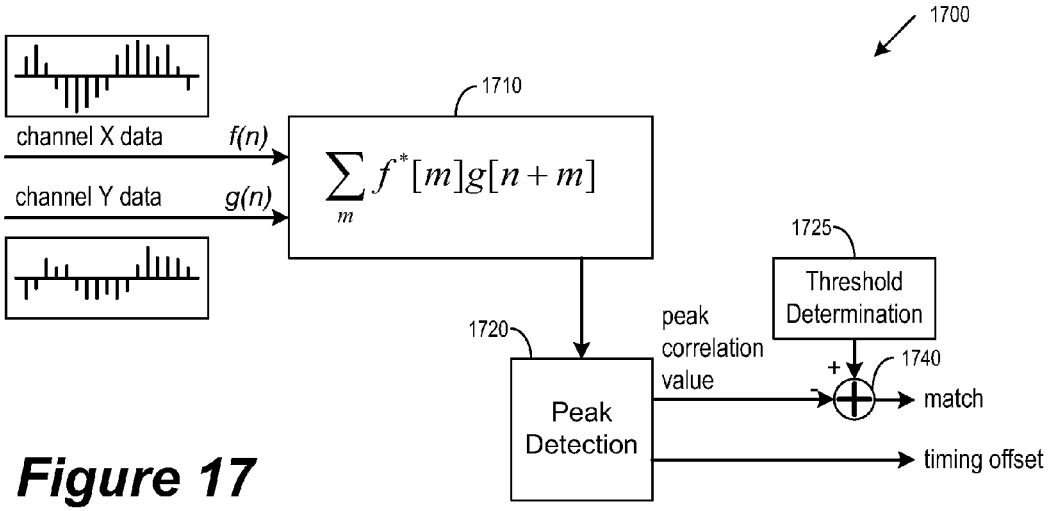
FIG. 17 illustrates an example block diagram of a cross correlation pairing detection module that uses cross correlation for determining pairing of audio channels.
Figure 18:
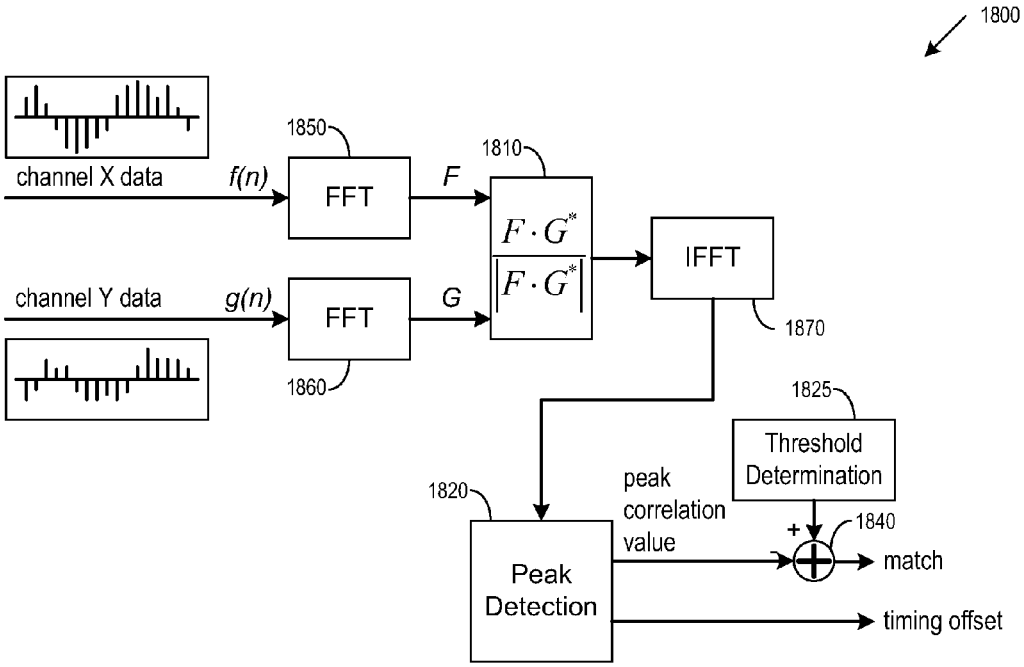
FIG. 18 illustrates an example block diagram of a phase correlation pairing detection module that uses phase correlation for determining pairing of audio channels.

Equation (5) is the result of a correlation operation performed in the time domain, which is sometimes referred to as "cross correlation." Correlation operations can also be performed in the frequency domain. Frequency domain correlation is sometimes referred to as "phase correlation." To perform phase correlation, some embodiments initially perform a transform operation (e.g., Fast Fourier Transform or FFT) to transform the timing domain audio data into frequency domain audio data. After performing the transform operation, these embodiments then perform frequency domain correlation operations (e.g., by cross multiplying frequency components). Finally, these embodiments perform an inverse transform operation (e.g., inverse FFT, or IFFT) to obtain a time domain correlation function similar to equation (5) above. FIG. 17 illustrates an example time domain cross correlation operation and FIG. 18 illustrates an example frequency domain phase correlation operation.

FIG. 17 illustrates an example block diagram of a cross correlation pairing detection module 1700 of some embodiments that uses cross correlation to determine pairing of audio channels. As illustrated in FIG. 17, a cross correlation pairing detection module 1700 includes a time domain correlation module 1710, a peak detection module 1720, a threshold determination module 1725, and a matching indicator 1740. Audio data from a candidate pair of audio channels, channel X and channel Y, are fed to the time domain correlation module 1710. Based on the contents of channel X and channel Y, the time domain correlation module 1710 produces a correlation function in which each sample at a particular timing offset represents the degree of correlation between audio channel X and audio channel Y. An example of such a correlation function is further described below by reference to FIG. 19.

The peak detection module 1720 detects the maximum or peak value in the correlation function. If the peak correlation value satisfies the threshold provided by the threshold determination module 1725, the matching indicator 1740 produces a matching indication. In some embodiments, the determination of whether the comparison score satisfies the threshold is accomplished by using an adder, a subtractor, or other arithmetic logic in the match indicator 1740. In some embodiments, the peak detection module 1720 also reports the timing offset of the peak correlation value as the timing offset between the two channels. As mentioned above by reference to FIG. 9, some embodiments use the timing offset to further qualify whether the two channels are a pair of stereo channels, since two audio channels cannot be a stereo pair if the timing offset between them are too great, even if the two audio channels contain identical content. Examples of using the peak value in the correlation function to determine whether the two channels match, and to determine the timing offset between the two channels, is described below by reference to FIG. 19.

Cross correlation of channel X and channel Y in the time domain, when the channel X data and the channel Y data both include N discrete samples, is an operation that requires $O(N^2)$ multiplication operations. In contrast, phase correlation of channel X and channel Y in the frequency domain requires only $O(N \cdot \log(N))$ multiplication operations. Therefore, in order to reduce computation complexity, some embodiments use frequency domain correlation (e.g., phase correlation) instead of time domain cross correlation for detection of audio channel pairs. FIG. 18 illustrates an example block diagram of a phase correlation pairing detection module 1800 that uses phase correlation to determine pairings of audio channels.

As illustrated in FIG. 18, the phase correlation pairing detection module 1800 includes a frequency domain correlation module 1810, a peak detection module 1820, a threshold determination module 1825, and a matching indicator 1840. In addition, the phase correlation pairing detection module 1800 includes Fast Fourier Transform (FFT) modules 1850 and 1860, and an Inverse Fast Fourier Transform (IFFT) module 1870.

Audio data from a candidate pair of channels, channel X and channel Y, is transformed into the frequency domain by FFT modules 1850 and 1860. Frequency domain correlation module 1810 receives FFT versions of the channel X data and the channel Y data, and performs correlation in the frequency domain. Unlike time domain channel data, which includes a series of time domain samples of the channel data, frequency domain channel data (e.g., FFT versions of the channel X and channel Y data) includes a series of numbers that correspond to each frequency component of the channel data.

The frequency domain correlation module 1810 multiplies each frequency component of the transformed channel X data with the complex conjugate versions of each frequency component of the transformed channel Y data. In some embodiments, the frequency correlation module 1810 normalizes each frequency component. This cross multiplication produces a frequency domain correlation function that includes a series of numbers that correspond to each frequency component of the correlation function. The IFFT module 1870 then transforms the frequency domain correlation function into a time domain correlation function, where each sample corresponds to a correlation value at a timing offset between channel X and channel Y. An example of such a correlation function is further described below by reference to FIG. 19.

The peak detection module 1820 detects the maximum or peak value in the time domain correlation function, and uses the peak value as the comparison score. If the peak correlation value satisfies the threshold produced by the threshold determination module 1825, the matching indicator 1840 produces a matching indication. In some embodiments, the determination of whether the comparison score satisfies the threshold 1825 is accomplished by using an adder, a subtractor, or other arithmetic logic in the match indicator 1840. In some embodiments, the peak detection module 1820 also detects a timing offset between the two channels. As mentioned above by reference to FIG. 9, some embodiments use the timing offset to further qualify whether the two channels are a pair of stereo channels.

Figure 19:
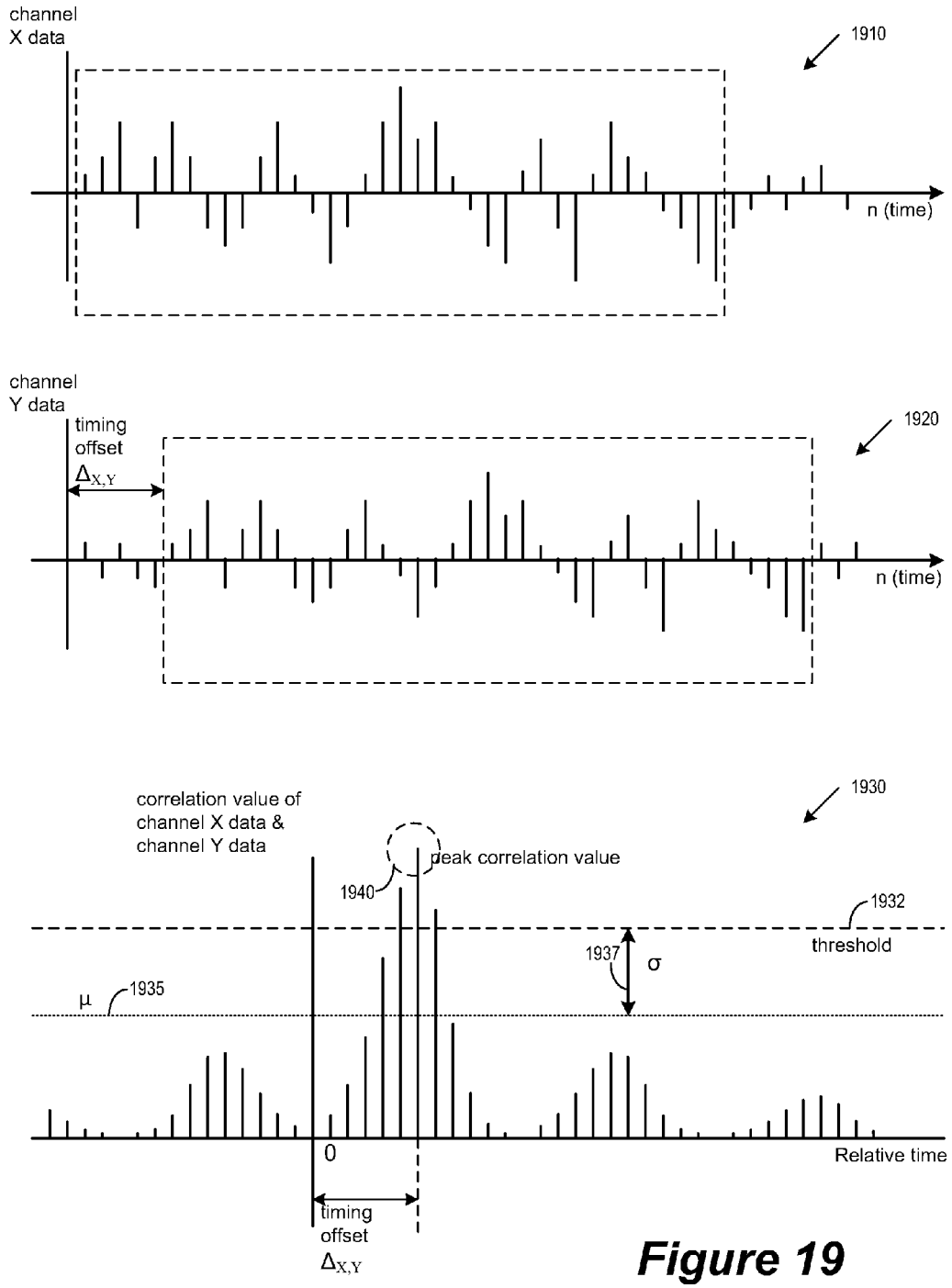
FIG. 19 illustrates the detection of a timing offset that can be performed by either a cross correlation pairing detection module or a phase correlation pairing detection module.

FIG. 19 illustrates the detection of the timing offset performed by either the cross correlation pairing detection module 1700, or the phase correlation pairing detection module 1800. FIG. 19 includes an example discrete waveform 1910 representing the content of channel X, and an example discrete waveform 1920 representing the content of channel Y. FIG. 19 also includes an example correlation function 1930 between the content of channel X and the content of channel Y. The waveform 1910 for channel X is similar (but not identical) to the waveform 1920 for channel Y. There is a timing offset $\Delta_{X,Y}$ between the example waveforms 1910 and 1920.

As mentioned above with respect to FIGS. 17 and 18, the correlation function 1930 is a function that reveals how well the two channels match each other at various timing offsets. The correlation function has a peak. The position of the peak reveals the timing offset at which the two channels most closely match each other. This position is identified as the timing offset between the two channels in some embodiments. In the example illustrated in FIG. 19, the peak correlation occurs at a position on the horizontal axis (relative time) that is $\Delta_{X,Y}$ away from the vertical axis. This corresponds to a timing offset of $\Delta_{X,Y}$ between channel X and channel Y.

The correlation function waveform 1930 also illustrates a threshold value 1932. Channel X and channel Y are considered a matching pair when the peak correlation value 1940 exceeds this threshold. In some embodiments, the determination of the threshold value 1932 is performed by the threshold determination module 1725 of FIG. 17 for cross correlation, or the threshold determination module 1825 of FIG. 18 for phase correlation.

Some embodiments determine this threshold based on a statistical analysis of the correlation function 1930. For example, some embodiments first calculate an average value 1935 (μ) and a standard deviation 1937 (σ) of the correlation function 1930, and then set the threshold to be one or more standard deviations above the average value μ. This is done, in some embodiments, to distinguish true matching from false matching, because two signals that correlate with each other well have a sharp peak correlation value that is usually one or more standard deviations above the average value 1935 GO, while two signals that poorly correlate usually have peak correlation values that do not exceed the same threshold.

(3) Adjustment of Comparison Threshold

Regardless of the algorithm that is used to generate the comparison data or comparison score, in some embodiments, the threshold determination module 825 of FIG. 8 (likewise, 1240 of FIG. 12, 1725 of FIG. 17, and 1825 of FIG. 18) further adjusts the threshold value it provides according to other considerations. For example, as mentioned above with respect to FIG. 4, audio channels in an audio file may have native ordering or inherent organization such as tracks. Some embodiments obtain such native ordering information (e.g., tracks) by processing metadata (e.g., file names, track names, channel names) associated with the audio file.

Some of these tracks include multiple audio channels (e.g., track 451), while other tracks may each include only one audio channel (e.g., tracks 452-455). Since audio channels in the same track are more likely to include a matching stereo pair, some embodiments lower the threshold so channels in the same track are more likely to be recognized as a matching stereo pair and less likely to be considered mono channels. Conversely, audio channels in different tracks are less likely to be in a matching stereo pair. Some embodiments thus raise the threshold for channels in different tracks so channels in different tracks are less likely to be regarded as matching stereo pairs and more likely to be considered mono channels.

Figure 20A:
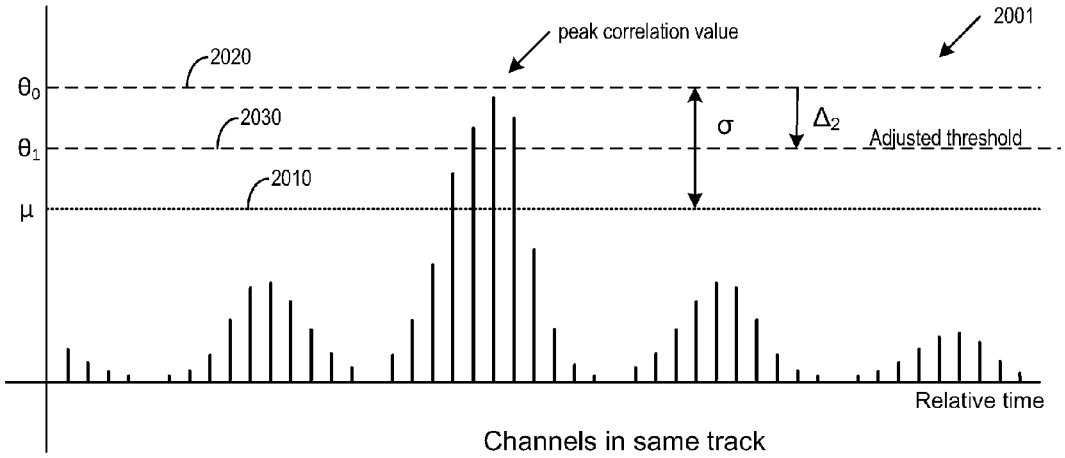
FIG. 20*a* illustrates an adjustment of a threshold value to increase the likelihood that two audio channels being compared are recognized as a matching pair when the two channels are in the same track.

FIG. 20*a* illustrates an adjustment of the threshold value to increase the likelihood that the two audio channels being compared are recognized as a matching pair when the two channels are in the same track. FIG. 20*a* illustrates example comparison data that is generated by a pairing detection module performing correlation between two audio channels in the same track. The comparison data (i.e., correlation function) 2001 has a peak correlation value that is below an initial threshold value 2020 ($\theta_0$). The initial threshold value 2020 ($\theta_0$) is calculated based on an average 2010 (μ) of the audio signal. Because the channels are in the same track, a threshold determination module (such as 1725 or 1825) calculates an adjusted threshold value 2030 ($\theta_1$) that is lower than the initial threshold value ($\theta_0$). As a result, the comparison score (the peak correlation value) will satisfy the adjusted threshold and the two channels will be recognized as a matching pair.

Figure 20B:
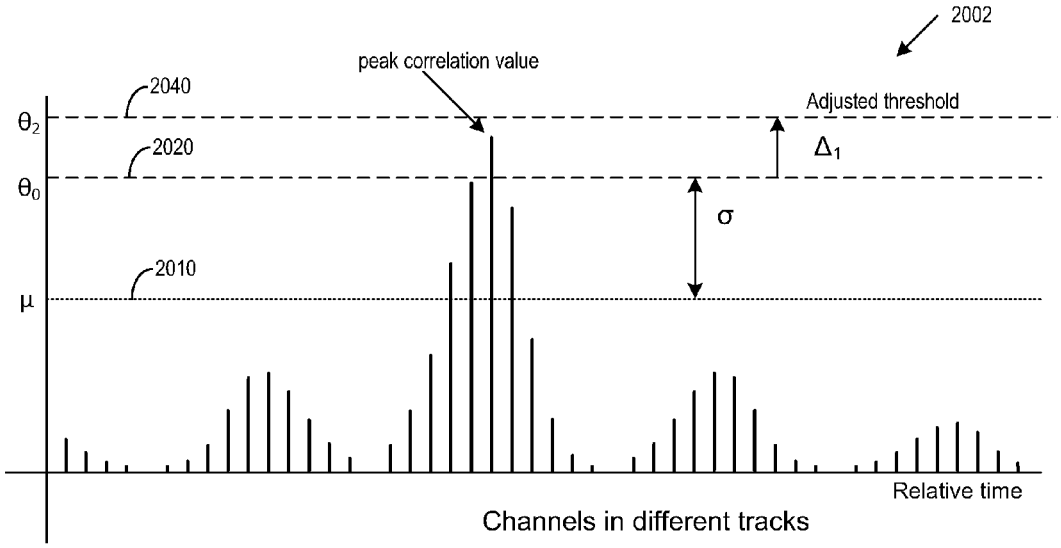
FIG. 20*b* illustrates an adjustment of a threshold value to decrease the likelihood that two of audio channels being compared are recognized as a matching pair when the two channels are not in the same track.

FIG. 20*b* illustrates an adjustment of the threshold value to decrease the likelihood that the two audio channels being compared are recognized as a matching pair when the two channels are not in the same track. FIG. 20*b* illustrates example comparison data that is generated by a pairing detection module performing correlation between two audio channels not in the same track. The comparison data (i.e., correlation function) 2002 has a peak correlation value that is above the initial threshold value 2020 ($\theta_0$). Because the two channels are in different tracks, the threshold determination module calculates an adjusted threshold value 2040 ($\theta_2$) that is higher than the initial threshold value ($\theta_0$). As a result, the comparison score (the peak correlation value) will not satisfy the adjusted threshold and the two channels will not be recognized as a matching pair.

The threshold adjustment examples illustrated in FIGS. 20*a* and 20*b* are based on a pairing detection module that performs correlation and generates a comparison score based on the peak correlation value. However, the adjustment of the threshold, as illustrated in FIGS. 20*a* and 20*b*, applies equally well to embodiments that perform other comparison algorithms for generating a comparison score. For example, the threshold determination unit 1240 of FIG. 12 (zero crossing pairing detection module) in some embodiments performs similar threshold adjustment operations as the ones described in FIGS. 20*a* and 20*b*. In some of these embodiments the threshold provided by the threshold determination unit 1240 is raised or lowered, depending on considerations such as whether the two audio channels being compared are in the same track or in different tracks. In addition, other indications of native ordering may be used to adjust the thresholds in some embodiments. The comparison score generated by zero crossing analysis (i.e., by zero crossing spectrum comparator 1230) is then measured against the adjusted threshold for determining whether the two channels being compared are a matching pair.

III. Software Architecture

Figure 21:
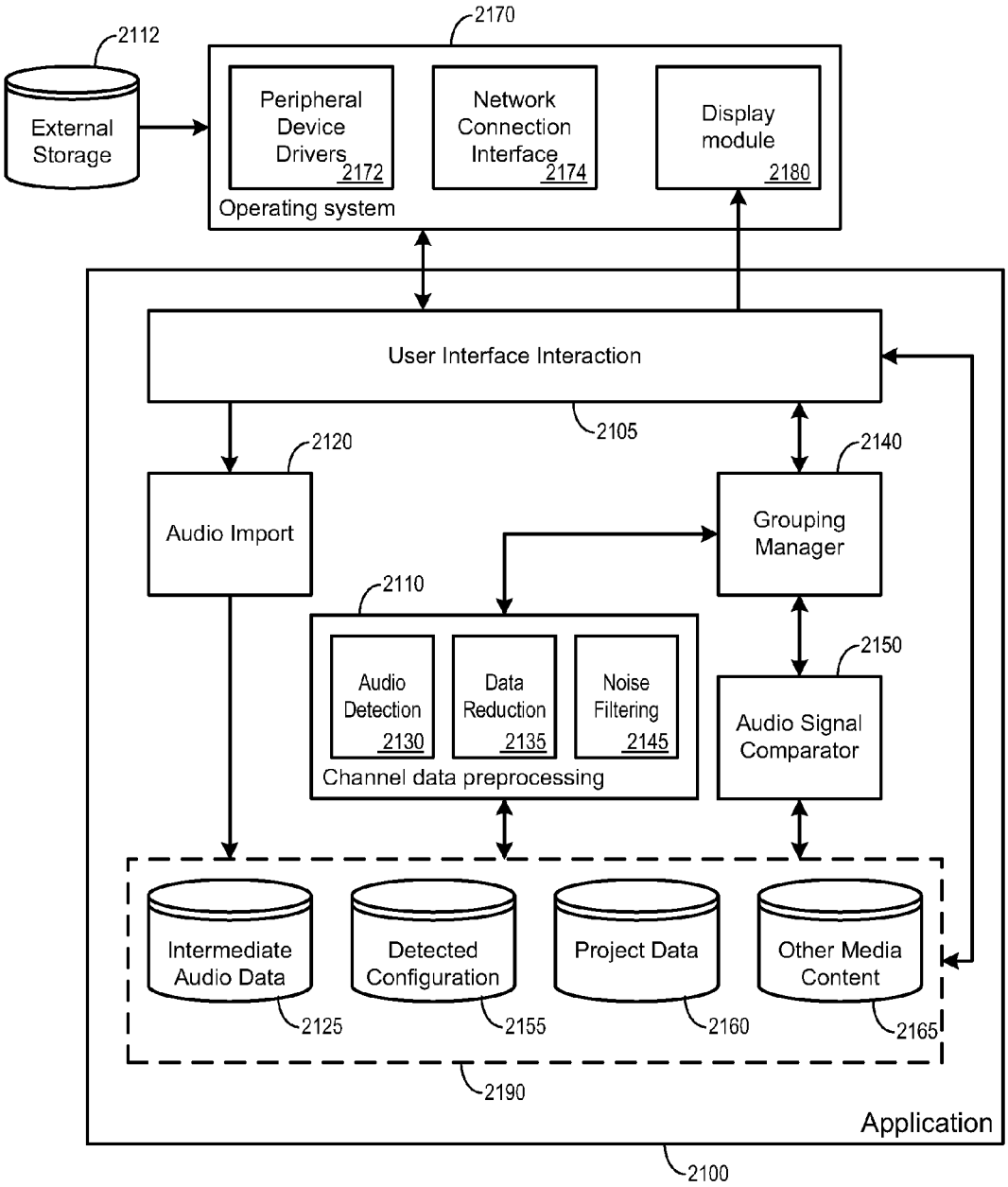
FIG. 21 conceptually illustrates the software architecture of a media editing application of some embodiments.

In some embodiments, the processes described above are implemented as software running on a particular machine, such as a computer or a handheld device, or stored in a computer readable medium. FIG. 21 conceptually illustrates the software architecture of a media editing application 2100 of some embodiments. In some embodiments, the media editing application is a stand-alone application or is integrated into another application, while in other embodiments the application might be implemented within an operating system. Furthermore, in some embodiments, the application is provided as part of a server-based solution. In some of these embodiments, the application is provided via a thin client. That is, the application runs on a server while a user interacts with the application via a separate machine that is remote from the server. In other such embodiments, the application is provided via a thick client. That is, the application is distributed from the server to the client machine and runs on the client machine.

The media editing application 2100 includes a user interface (UI) interaction module 2105, an audio import module 2120, a channel data pre-processing module 2110, a grouping manager 2140, and an audio signal comparator 2150. The media editing application 2100 also includes intermediate audio data storage 2125, detected configuration storage 2155, project data storage 2160, and other media content storage 2165. In some embodiments, the intermediate audio data storage 2125 stores audio data that has been processed by modules of the media editing application, such as the imported audio data that has been properly formatted, audio data that has been noise filtered or reduced, and other intermediate audio data produced during the audio channel configuration detection operation.

In some embodiments, storages 2125, 2155, 2160, and 2165 are all stored in one physical storage 2190. In other embodiments, the storages are in separate physical storages, or two of the storages are in one physical storage, while the third storage is in a different physical storage. For instance, the intermediate audio data storage 2125, the detected configuration storage 2155, the project data storage 2160, and the other media content storage 2165 will often not be separated in different physical storages.

FIG. 21 also illustrates an operating system 2170 that includes input peripheral driver(s) 2172, a display module 2180, and network connection interface(s) 2174. In some embodiments, as illustrated, the input peripheral drivers 2172, the display module 2180, and the network connection interfaces 2174 are part of the operating system 2170, even when the media editing application 2100 is an application separate from the operating system.

The peripheral device drivers 2172 may include drivers for accessing external storage devices 2112, such as flash drives or external hard drives. The peripheral device drivers 2172 then deliver the data from the external storage device 2112 to the UI interaction module 2105. The peripheral device drivers 2172 may also include drivers for translating signals from a keyboard, mouse, touchpad, tablet, touchscreen, etc. A user interacts with one or more of these input devices, which send signals to their corresponding device drivers. The device drivers then translate the signals into user input data that is provided to the UI interaction module 2105.

The media editing application 2100 of some embodiments includes a graphical user interface that provides users with numerous ways to perform different sets of operations and functionalities. In some embodiments, these operations and functionalities are performed based on different commands that are received from users through different input devices (e.g., keyboard, track pad, touchpad, touchscreen, mouse, etc.) For example, the present application describes a selection of a graphical user interface object by a user for activating the channel configuration detection operation. Such selection can be implemented by an input device interacting with the graphical user interface. In some embodiments, objects in the graphical user interface can also be controlled or manipulated through other controls, such as touch controls. In some embodiment, touch control is implemented through an input device that can detect the presence and location of touch on a display of the device. An example of such a device is a touch screen device. In some embodiments, with touch control, a user can directly manipulate objects by interacting with the graphical user interface that is displayed on the display of the touch screen device. For instance, a user can select a particular object in the graphical user interface by simply touching that particular object on the display of the touch screen device. As such, when touch control is utilized, a cursor may not even be provided for enabling selection of an object of a graphical user interface in some embodiments. However, when a cursor is provided in a graphical user interface, touch control can be used to control the cursor in some embodiments.

The display module 2180 translates the output of a user interface for a display device. That is, the display module 2180 receives signals (e.g., from the UI interaction module 2105) describing what should be displayed and translates these signals into pixel information that is sent to the display device. The display device may be an LCD, plasma screen, CRT monitor, touchscreen, etc.

The network connection interface 2174 enable the device on which the media editing application 2100 operates to communicate with other devices (e.g., a storage device located elsewhere in the network that stores the raw audio data) through one or more networks. The networks may include wireless voice and data networks such as GSM and UMTS, 802.11 networks, wired networks such as Ethernet connections, etc.

The UI interaction module 2105 of media editing application 2100 interprets the user input data received from the input device drivers and passes it to various modules, including the audio import module 2120 and the grouping manager 2140. The UI interaction module also manages the display of the UI, and outputs this display information to the display module 2180. This UI display information may be based on information from the grouping manager 2140, from detected configuration data storage 2155, or directly from input data (e.g., when a user moves an item in the UI that does not affect any of the other modules of the application 2100).

The audio import module 2120 receives the raw audio data (from an external storage via the UI module 2105 and the operating system 2180), and then parses and formats the audio data into a form that can be processed by other modules, as described above by reference to FIG. 1. The audio import module 2120 stores formatted audio data into intermediate audio data storage 2125.

The channel data preprocessing module 2110 fetches the audio data parsed and formatted by the audio import module 2120 and performs audio detection, data reduction, and noise filtering functions. In some embodiments, these functions are performed by audio detection module 2130, data reduction module 2140 and noise filtering module 2145, respectively. Each of these functions fetches audio data from the intermediate audio data storage 2125, and performs a set of operations on the fetched data (e.g., data reduction or noise filtering as discussed above by reference to FIGS. 10 and 11) before storing a set of processed audio data into the intermediate audio data storage 2125. In some embodiments, the channel data preprocessing module 2110 also directly communicates with the grouping manager module 2140 to report the result of the preprocessing operation (e.g., to report which channel has useful/valid audio content as discussed above by reference to FIG. 6).

The audio signal comparator module 2150 receives selections of channels from the grouping manager 2140 and retrieves two sets of audio data from the intermediate audio data storage 2125. The audio signal comparator module 2150 then performs the channel comparison operation and stores the intermediate result in storage. Upon completion of the comparison operation, the audio signal comparator module 2150 communicates with the grouping manager 2140 as to whether the two channels are a match pair.

The grouping manager module 2140 receives a command from the UI module 2105, receives the result of the preprocessing operation from the channel data preprocessing module 2110, and controls the audio signal comparator module 2150. The grouping manager 2140 selects pairs of channels for comparison and directs the audio signal comparator 2150 to fetch the corresponding audio data from storage for comparison. The grouping manager 2140 then compiles the result of the comparison and stores audio channel configuration data in the detected configuration storage 2155 for the rest of the media editing application 2100 to process. The media editing application 2100 in some embodiments retrieves this audio channel configuration data and determines an assignment of audio channels to audio speakers.

While many of the features have been described as being performed by one module (e.g., the grouping manager 2140 and the audio signal comparator 2150) one of ordinary skill in the art will recognize that the functions described herein might be split up into multiple modules. Similarly, functions described as being performed by multiple different modules might be performed by a single module in some embodiments (e.g., audio detection, data reduction, noise filtering, etc.).

IV. Computer System

Many of the above-described features and applications are implemented as software processes that are specified as a set of instructions recorded on a computer readable storage medium (also referred to as computer readable medium). When these instructions are executed by one or more computational element(s) (such as processors or other computational elements like ASICs and FPGAs), they cause the computational element(s) to perform the actions indicated in the instructions. Computer is meant in its broadest sense, and can include any electronic device with a processor. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs when installed to operate on one or more computer systems define one or more specific machine implementations that execute and perform the operations of the software programs.

Figure 22:
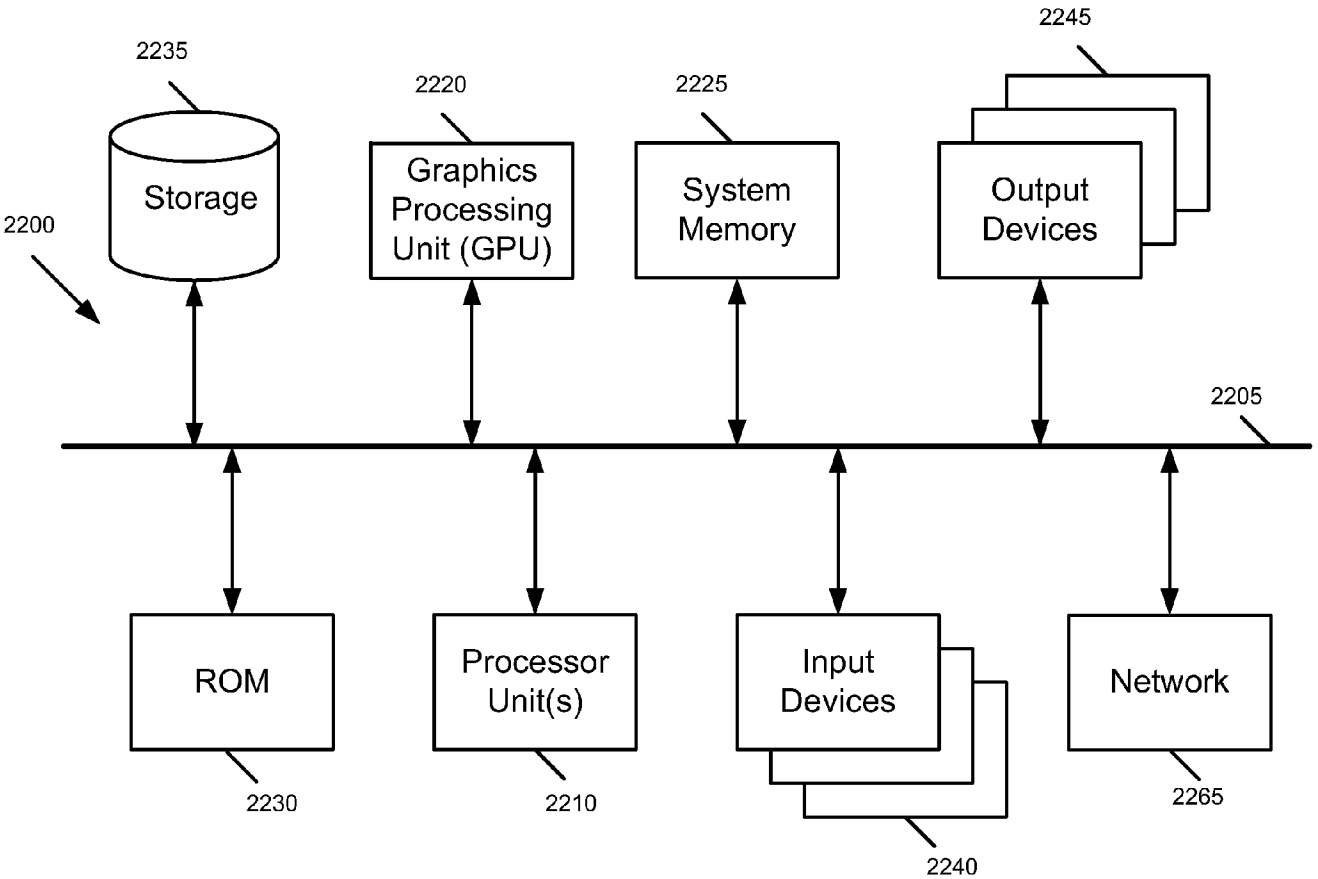
FIG. 22 conceptually illustrates a computer system with which some embodiments of the invention are implemented.

FIG. 22 conceptually illustrates a computer system with which some embodiments of the invention are implemented. Such a computer system includes various types of computer readable media and interfaces for various other types of computer readable media. One of ordinary skill in the art will also note that the digital video camera of some embodiments also includes various types of computer readable media. Computer system 2200 includes a bus 2205, processing unit(s) 2210, a graphics processing unit (GPU) 2220, a system memory 2225, a read-only memory (ROM) 2230, a permanent storage device 2235, input devices 2240, and output devices 2245.

The bus 2205 collectively represents all system, peripheral, and chipset buses that communicatively connect the numerous internal devices of the computer system 2200. For instance, the bus 2205 communicatively connects the processing unit(s) 2210 with the read-only memory 2230, the GPU 2220, the system memory 2225, and the permanent storage device 2235.

From these various memory units, the processing unit(s) 2210 retrieve instructions to execute and data to process in order to execute the processes of the invention. The processing unit(s) may be a single processor or a multi-core processor in different embodiments. While the discussion in this section primarily refers to software executed by a microprocessor or multi-core processor, in some embodiments the processing unit(s) include a Field Programmable Gate Array (FPGA), an ASIC, or various other electronic components for executing instructions that are stored on the processor.

Some instructions are passed to and executed by the GPU 2220. The GPU 2220 can offload various computations or complement the image processing provided by the processing unit(s) 2210. In some embodiments, such functionality can be provided using CoreImage's kernel shading language.

The read-only-memory 2230 stores static data and instructions that are needed by the processing unit(s) 2210 and other modules of the computer system. The permanent storage device 2235, on the other hand, is a read-and-write memory device. This device is a non-volatile memory unit that stores instructions and data even when the computer system 2200 is off. Some embodiments of the invention use a mass-storage device (such as a magnetic or optical disk and its corresponding disk drive) as the permanent storage device 2235.

Other embodiments use a removable storage device (such as a floppy disk, flash drive, or ZIP® disk, and its corresponding disk drive) as the permanent storage device. Like the permanent storage device 2235, the system memory 2225 is a read-and-write memory device. However, unlike storage device 2235, the system memory is a volatile read-and-write memory, such a random access memory (RAM). The system memory stores some of the instructions and data that the processor needs at runtime. In some embodiments, the invention's processes are stored in the system memory 2225, the permanent storage device 2235, and/or the read-only memory 2230. For example, the various memory units include instructions for processing multimedia items in accordance with some embodiments. From these various memory units, the processing unit(s) 2210 retrieves instructions to execute and data to process in order to execute the processes of some embodiments.

The bus 2205 also connects to the input and output devices 2240 and 2245. The input devices enable the user to communicate information and select commands to the computer system. The input devices 2240 include alphanumeric keyboards and pointing devices (also called "cursor control devices"). The output devices 2245 display images generated by the computer system. The output devices include printers and display devices, such as cathode ray tubes (CRT) or liquid crystal displays (LCD).

Finally, as shown in FIG. 22, bus 2205 also couples computer 2200 to a network 2265 through a network adapter (not shown). In this manner, the computer can be a part of a network of computers (such as a local area network ("LAN"), a wide area network ("WAN"), or an Intranet, or a network of networks, such as the internet. Any or all components of computer system 2200 may be used in conjunction with the invention.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processor and includes sets of instructions for performing various operations. Examples of hardware devices configured to store and execute sets of instructions include, but are not limited to application specific integrated circuits (ASICs), field programmable gate arrays (FPGA), programmable logic devices (PLDs), ROM, and RAM devices. Examples of computer programs or computer code include machine code, such as is produced by a compiler, and files including higher-level code that are executed by a computer, an electronic component, or a microprocessor using an interpreter.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

While the invention has been described with reference to numerous specific details, one of ordinary skill in the art will recognize that the invention can be embodied in other specific forms without departing from the spirit of the invention. In addition, a number of the figures (including FIGS. 5, 7, and 9) conceptually illustrate processes. The specific operations of these processes may not be performed in the exact order shown and described. The specific operations may not be performed in one continuous series of operations, and different specific operations may be performed in different embodiments. Furthermore, the process could be implemented using several sub-processes, or as part of a larger macro process.

While the examples illustrated in FIGS. 2*a* and 2*b* describes the detection of audio channel configuration for dual stereo and 5.1 surround sound configurations, other embodiments detect any pair-wise matching of audio channels and multiple groupings or pairings of audio channels.

Figure 23:
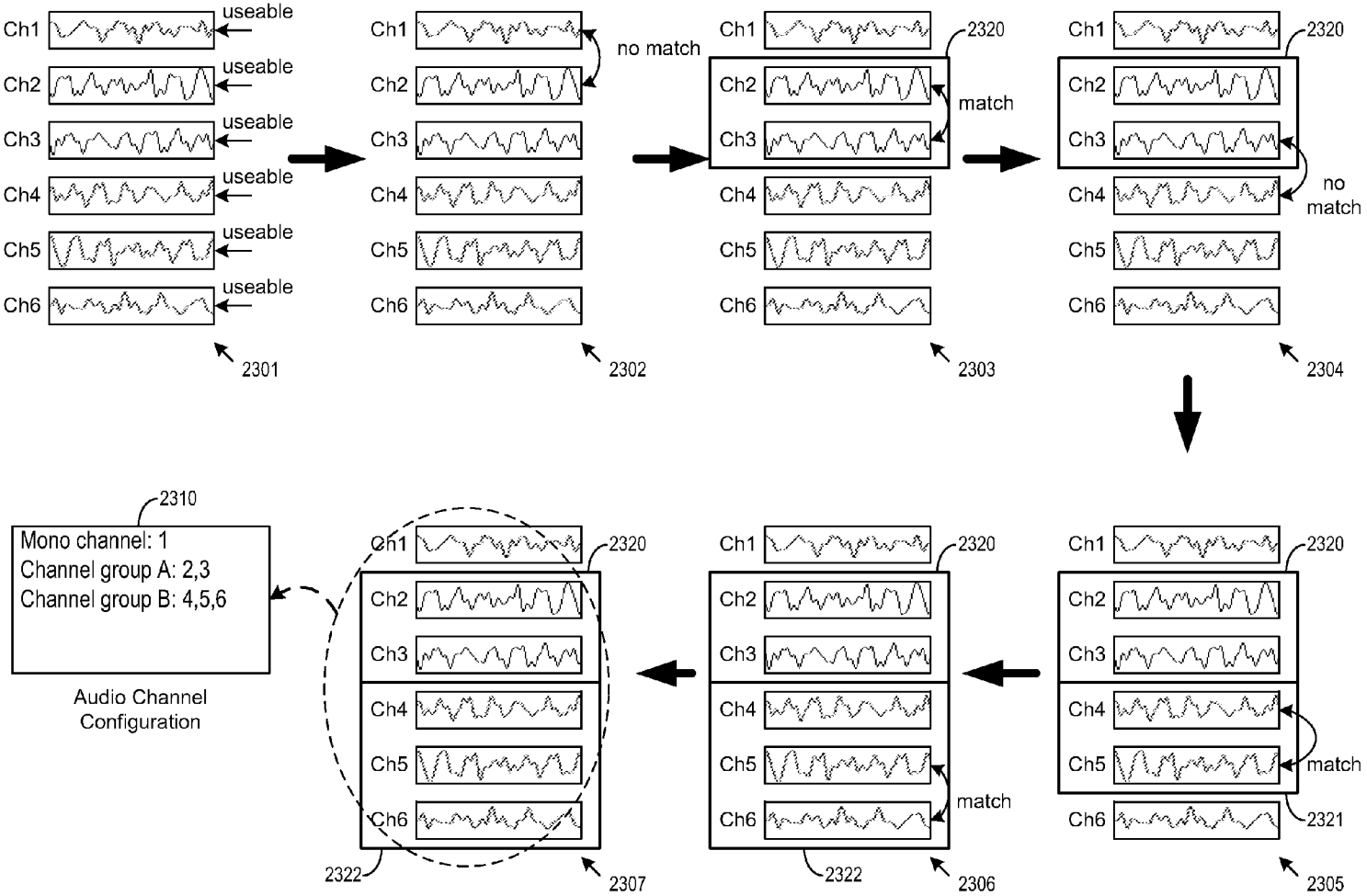
FIG. 23 illustrates an example of detection of multiple groupings or pairings of channels.

FIG. 23 illustrates an example of detection of multiple groupings or pairings of channels in seven stages 2301-2307. At stage 2301, six channels of audio data are presented to the computing device 100 of FIG. 1. All channels ("Ch1", "Ch2", "Ch3", "Ch4", "Ch5" and "Ch6") have valid audio data and tagged as "useable" by the audio detector module 130.

At the second stage 2302, the computing device 100 compares "Ch1" with "Ch2" and receives an indication that "Ch1" and "Ch2" do not match. At the third stage 2303, the computing device 100 compares "Ch2" with "Ch3" and receives an indication that "Ch2" and "Ch3" match and that "Ch2" and "Ch3" form a stereo pair as denoted by the rectangle 2320.

At the fourth stage 2304, the computing device 100 compares "Ch3" with "Ch4" and receives an indication that "Ch3" and "Ch4" do not match. At the fifth stage 2305, the computing device 100 compares "Ch4" and "Ch5" and receives an indication that "Ch4" and "Ch5" match and that "Ch4" and "Ch5" form a stereo pair as denoted by the rectangle 2321.

At the sixth stage, the computing device 100 compares "Ch5" with "Ch6" and receives an indication that "Ch5" and "Ch6" match and that "Ch4", "Ch5" and "Ch6" form a grouping of related channels as denoted by the rectangle 2322.

At the seventh stage 2307, the computing device 100 generates an audio channel configuration data 2310 based on the result of the operations performed during stages 2301-2306. In this example, "Ch2" and "Ch3" are identified as a pair of stereo channels, "Ch4", "Ch5" and "Ch6" are identified as a grouping of related channels, while "Ch1" is identified as being a mono channel.

What is claimed is:

1. A non-transitory computer readable medium storing instructions for detecting an audio channel configuration, which when executed by one or more processing units performs a method, the method comprising:

receiving a multi-channel audio file;

determining an audio signal level for each channel in the multi-channel audio file;

identifying channels containing usable audio content, wherein the identifying includes a determination whether each channel comprises the audio signal level of at least a threshold signal level; and using the channels identified as containing usable audio content, determining a comparison score between each channel based on the usable audio content;

identifying a pairing of channels based on the comparison score.

2. The computer readable medium of claim 1, wherein identifying the pairing of channels based on the comparison score comprises determining a pair of stereo channels out of all channels in the multi-audio file.

3. The computer readable medium of claim 1, further comprising:

identifying channels not in any pairing of channels as mono channels.

4. The computer readable medium of claim 1, further comprising:

identifying the first channel and the second channel as a pairing of channels if the comparison score satisfies a threshold.

5. The computer readable medium of claim 1, wherein the comparison score is based on a correlation of the audio content of the first channel and the audio content of the second channel.

6. The computer readable medium of claim 5, wherein the comparison score is a peak value of said correlation.

7. The computer readable medium of claim 5, further comprising:

determining an offset value between the first channel and the second channel, wherein the offset value is determined based on a position of the peak value.

8. The computer readable medium of claim 7, further comprising:

identifying the first channel and the second channel as not being in a pairing of channels if the offset value is greater than a threshold.

9. The computer readable medium of claim 1, wherein the comparison score is based on a comparison of a first zero crossing spectrum of the first channel and a second zero crossing spectrum of the second channel.

10. The computer readable medium of claim 9, wherein a zero crossing spectrum for a channel comprises a plurality of zero crossing counts, wherein each of the plurality of zero crossing counts corresponds to a number of times a difference function of the channel's audio content crosses zero.

11. A method for detecting audio channel configuration, the method comprising:

receiving a multi-channel audio file;

determining an audio signal level for each channel in the multi-channel audio file;

identifying channels containing usable audio content, wherein the identifying includes a determination whether each channel comprises the audio signal level of at least a threshold signal level; and using the channels identified as containing usable audio content, identifying a first channel and a second channel;

comparing the first channel with the second channel, wherein comparing the channels includes determining a comparison score between the first and second channels based on the usable audio content; and based on said comparison, determining a relationship between the first and the second channel, wherein determining a relationship includes identifying whether the first and second channels are a pair based on the comparison score.

12. The method of claim 11, wherein comparing the first channel with the second channel comprises reducing the size of data sets representing the audio content of the first and second channels.

13. The method of claim 12, wherein the multi-channel audio data is sampled at a first sampling frequency, wherein reducing the size of the data set comprises re-sampling the audio content of the first channel at a second sampling frequency that is slower than the first sampling frequency.

14. The method of claim 12, wherein reducing the size of the data set comprises accumulating a plurality of adjacent data points into a single data point representing average power of the data set.

15. The method of claim 11 further comprising determining a relationship between at least one additional channel and the first and second channels.

16. The method of claim 15 further comprising identifying the at least one additional channels as channels in a surround sound configuration that includes a pairing of stereo channels and the at least one additional channels.

17. The method of claim 16 further comprising determining the surround sound configuration based on positions of the pairing of stereo audio channels.

18. The method of claim 17, wherein determining the surround sound configuration further comprises determining a position of a low frequency channel.

19. The method of claim 11 further comprising:

identifying third and fourth channels containing audio content from the multichannel audio data;

comparing the third channel with the fourth channel; and based on the comparison, determining that the third channel and the fourth channel is a second pairing of stereo audio channels.

20. The method of claim 11, wherein the multichannel audio data is received from a plurality of audio files.

21. A computing device for determining a configuration of audio channels in an audio data generated by an audio recorder, the audio data comprising audio contents from a plurality of audio channels, the computer device comprising:

an audio capture module for receiving the audio data;

an audio detector module for detecting, from the audio file, audio channels with useable audio content, wherein the detection includes determining an audio signal level for each channel in the multi-channel audio file and identifying channels containing usable audio content, wherein identifying channels containing usable audio content includes a determination whether each channel comprises the audio signal level of at least a threshold signal level; and a comparator module for determining a configuration of the audio channels by comparing first and second audio channels, wherein the comparator compares the first and second audio channels by generating a comparison score based on the usable audio content, and wherein based on the comparison score a pairing of channels is identified.

22. The computing device of claim 21, wherein the comparator determines the configuration of audio channels by identifying the first channel and the second channel as a pairing of channels if the comparison score satisfies a threshold.

23. The computing device of claim 21 further comprising a threshold determination module for determining the threshold, wherein the threshold determining module adjusts the threshold based on a derived native ordering of the audio channels.

* * * * *